US006505924B2

(12) United States Patent
Shimizu

(10) Patent No.: US 6,505,924 B2
(45) **Date of Patent: *Jan. 14, 2003**

(54) INK CARTRIDGE

(75) Inventor: Seiji Shimizu, Oogaki (JP)

(73) Assignee: Brother Kogyo Kabushiki Kaisha, Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 25 days.

(21) Appl. No.: 09/409,391

(22) Filed: Sep. 30, 1999

(65) Prior Publication Data

US 2001/0040612 A1 Nov. 15, 2001

(30) Foreign Application Priority Data

Sep. 30, 1998 (JP) ..... 10-278535
Sep. 30, 1998 (JP) ..... 10-278542

(51) Int. Cl.[7] ..... B41J 2/175
(52) U.S. Cl. ..... 347/86; 347/85
(58) Field of Search ..... 347/86, 85, 87

(56) References Cited

U.S. PATENT DOCUMENTS 5,574,489 A * 11/1996 Cowger et al. ..... 347/86

FOREIGN PATENT DOCUMENTS

EP 0 899 112 A2 * 3/1999 ..... B41J/2/175
JP A-6-183023 7/1994

* cited by examiner

*Primary Examiner*—Lamson Nguyen
(74) *Attorney, Agent, or Firm*—Oliff & Berridge, PLC

(57) ABSTRACT

The invention provides a ink cartridge for supplying ink, including an ink pack formed from a flexible bag to seal liquid ink therein, a cartridge body having an ink pack housing therein, an extraction opening having a rubber plate into which a hollow ink extracting needle is inserted, an upper supporting spring movably supported with one end thereof by the cartridge body and affixed to the upper surface of the ink pack, and a lower supporting plate affixed to the lower surface of the ink pack and the lower surface of the cartridge body. A pair of the upper supporting spring and the lower supporting spring urges/pulls so that the volume of the bag of the ink pack is enlarged.

21 Claims, 23 Drawing Sheets

INK CARTRIDGE

BACKGROUND OF THE INVENTION

1. Field of Invention

The invention relates to an ink cartridge for use with a printing apparatus capable of performing printing via a liquid ink.

2. Description of Related Art

In an ink jet print head for use with a printing apparatus, such as an ink jet printer, a curved surface (meniscus) of ink liquid needs to be formed in ink nozzle openings of the ink jet print heads for printing to be performed properly. For the meniscus to be formed for proper printing, appropriate negative pressures need to be applied and maintained while ink is supplied.

A compact and lightweight ink cartridge exists that is used for a portable printer and the like, having a structure such that ink contained in a flexible bag of an ink pack is supplied to a print head from the ink pack through an ink extracting needle inserted into the ink pack. The ink cartridge having the flexible ink pack may maintain negative pressures therein due to the rigidity and strength of the bag.

However, to certainly apply and maintain the appropriate negative pressures for the above-described reasons, an upper supporting spring 151 is used in the following manner. As shown in FIG. 13, a thin sheet-like bag of an ink pack 109*a* is horizontally provided. The lower surface of the ink pack 109*a* is adhered to the lower surface of an ink pack housing 192 of an cartridge body 191, which has a generally box shape. To the upper surface of the ink pack 109*a*, an upper supporting spring 151 whose one end is secured by the cartridge body 191, is adhered. Using only one upper supporting spring 151, the ink pack 109*a* is urged/pulled so as to expand upwardly. In such ink cartridge, negative pressures can certainly be applied to the ink by the upper supporting spring 151.

In the ink cartridge employing above-described structure, the ink extracting needle 110 for extracting ink needs to be inserted into the ink pack 109*a*. For the ink extracting needle 110 to be easily inserted, the upper and lower surfaces of the ink pack 109*a* are fixed to the upper supporting spring 151 or the cartridge body 191. The ink extracting needle 110 is inserted into an insert portion 109*c* provided in the substantially central portion of the ink pack 109*a* when it is fixed with the upper and lower surfaces thereof, so that the sharp pointed end of the needle does not interfere with the bag of the ink pack 109*a*.

However, when the ink is used and the volume of the ink pack 109*a* decreases, the ink extracting needle 110 disposed in the central portion of the ink pack 109*a* prevents the upper supporting spring 151 from moving or bending down to apply negative pressures to the ink pack 109*a*,. Therefore, as shown in FIG. 14, the ink in the space defined between the upper supporting spring 151 and a double-sided adhesive tape attached to the lower surface of the ink pack housing 192 of the cartridge body 191 cannot be used. Since all the ink filled in the ink pack 109*a* cannot be used up, the ink is wasted or the time during which the ink can be continuously used, becomes short.

Furthermore, when the upper supporting spring 151 is only used to apply negative pressures to the small ink pack 109*a*, the upper supporting spring 151 applies small amounts of urging or pulling forces to the ink pack 109*a* filled up with the ink. As the ink is used and the volume of the ink in the ink pack 109*a* decreases, the upper supporting spring 151 applies greater amounts of urging/pulling forces to the ink pack 109*a* as the application point of the urging/pulling forces is changed and the upper supporting spring 151 bends down. Since the range where appropriate negative pressures can be applied only using the upper supporting spring 151 is small with respect to the amount of ink usage, it is difficult to maintain appropriate negative pressures from the start to the end of the ink usage. As appropriate negative pressures are not maintained, meniscuses (curved surfaces) of ink liquid are not properly formed in the nozzles of the ink jet print head, resulting in poor printing, such as excessive amounts of ink droplets ejected, splattered inks, ink blurred, and no ink ejected.

SUMMARY OF THE INVENTION

One aspect of the invention is to provide an ink cartridge that applies and maintains appropriate negative pressures from the start to the end of the ink usage, thereby supplying ink without any ink being wasted.

In accordance with the invention, an ink cartridge includes a flexible bag of an ink pack that contains liquid ink, a housing that houses the ink pack and has a box shape, an ink extracting portion provided at a side surface of the housing, into which a hollow ink extracting needle is inserted to extract the ink from the ink pack contained in the housing, and a pair of plate springs provided so as to dispose the ink extracting portion therebetween and movably supported with one end thereof at a portion of the housing to urge/pull the ink pack to the directions opposite to each other so that the volume of the ink pack is enlarged by fixing a portion of the plate spring to the ink pack.

Since the ink cartridge of this invention has two plate springs, they can be disposed according to the shape of the ink pack, and the ink pack can be urged/pulled upwardly and downwardly so as to apply negative pressures thereto. The ink remaining in the ink pack can be reduced and greater amounts of ink can be used from the ink pack urged/pulled by two plate springs than that urged/pulled by one plate spring, if the ink pack contains the same amount of ink. Consequently, the running costs of the printer are cut down and the time during which the printer can continuously be used becomes long.

Furthermore, since the two plate springs are used to urge/pull the ink pack, appropriate negative pressures can be applied to the ink pack in a wider range with respect to the amount of ink usage, than one plate spring used to apply negative pressures, wherein small amounts of urging/pulling forces are applied to the ink pack filled up with the ink and when the ink is used and the volume of the ink decreases, the greater amount of urging/pulling forces are applied as the application point of the urging/pulling forces is changed and the plate spring bends down. Since the appropriate negative pressures can be maintained from the start to the end of the ink usage using two plate springs, meniscuses (curved surfaces) of ink liquid are properly formed in the nozzles of the ink jet print head and poor printing, such as excessive amounts of ink droplets ejected, splattered inks, ink blurred, and no ink ejected will not occur.

In the ink cartridge of the invention, at least one of the pair of plate springs is supported near the ink extracting portion so as to dispose the ink extracting needle therebetween when the ink extracting needle is inserted.

Since the ink cartridge of this invention has two plate springs, they can be disposed according to the shape of the ink pack, especially according to the position of the ink extracting needle, and the ink pack can be urged/pulled upwardly and downwardly as to apply negative pressures thereto. The ink remaining in the ink pack can be reduced and a greater amount of ink can be used from the ink pack urged/pulled by two plate springs than that urged/pulled by one plate spring, if the ink pack contains the same amount of ink. Consequently, the running costs of the printer are cut down and the time during which the printer can continuously be used becomes long.

The at least one of the pair of plate springs has a substantially C- or O-shaped outer portion whose one end is movably supported at the housing and a central portion movably supported with an inner surface of the outer portion at the opposite side of the supporting portion of the outer portion, wherein the central portion is fixed to the ink pack.

Since the substantial length of the plate spring can be extended, the appropriate urging/pulling forces can be applied when the application point of the urging/pulling forces to the ink pack is greatly changed, and appropriate negative pressures can be applied to the ink pack in a wide range with respect to the amount of ink usage. Since the appropriate negative pressures can be maintained from the start to the end of the ink usage, meniscuses (curved surfaces) of ink liquid are properly formed in the nozzles of the ink jet print heads and the poor printing, such as an excessive amount of ink droplets ejected, splattered inks, ink blurred, and no ink ejected will not occur.

The substantially C- or O-shaped outer portion of the at least one of the pair of plate springs whose one end is movably supported at the housing, is supported at the portion opposite to that which the outer portion of the other plate spring is supported at.

Therefore, the two plate springs interact with each other to maintain appropriate negative pressures and to effectively reduce the ink remaining in the ink pack.

In the ink cartridge of this invention, the pair of plate springs are uniformly formed.

Therefore, it becomes possible to effectively produce one piece of plate spring.

Further, the housing contains a plurality of the ink packs.

Therefore, it becomes possible to supply a plurality of inks to a printing apparatus that performs printing using a plurality of inks for color printing.

In the ink cartridge of the invention, the ink is supplied to an ink jet print head included in an image forming apparatus.

Therefore, it becomes possible to properly supply the ink to the ink jet print head of the image forming apparatus.

In accordance with the invention, an ink cartridge includes a flexible bag of an ink pack that contains liquid ink, a housing that houses the ink pack, a first urging/pulling device that urges/pulls the bag of the ink pack to apply negative pressures to the liquid ink contained in the ink pack, a second urging/pulling device that applies negative pressures with smaller amounts of force than the first urging/pulling device does, a releasing device that releases the first urging/pulling device therefrom.

Since the releasing device releases the first urging/pulling device therefrom according to the amount of ink in the ink pack, appropriate negative pressures can be maintained with different amounts of urging/pulling forces applied. By adjusting the pressure of the liquid ink to be supplied at negative pressures appropriate for printing, proper meniscuses can be formed, and high-quality printing can be produced.

The releasing device includes an engagement portion fixed to the ink pack and an engagement catch, provided on the first urging/pulling device, to be engaged in the engagement portion, wherein the engagement catch engaged in the engagement portion is released by the positional change of the engagement portion due to the decrease in the amount of ink in the ink pack.

Since the releasing device releases the first urging/pulling device therefrom using the engagement portion that changes its position according to the amount of ink used, urging/pulling forces are adjusted according to the amount of ink used. Therefore, the appropriate urging/pulling forces are applied regardless of the amount of ink used, applying negative pressures appropriate for printing, to the ink.

Further, the releasing device has the engagement portion fixed to an opposite side of the ink pack fixed to the inner wall of the housing with a portion thereof and the engagement catch of a plate spring forming the first urging/pulling device whose one end is fixed to the inner wall of the housing with the predetermined supporting point, wherein the engagement catch is engaged in the engagement portion so as to urge/pull the ink pack to apply negative pressures thereto when more than a predetermined amount of liquid ink are filled in the ink pack, and the engagement portion releases the engagement catch therefrom when the predetermined amount of ink is used from the ink pack by changing its position downwardly from the supporting point of the first urging/pulling device as the ink is used.

Since the walls of the ink pack deform or move when ink is used, when a predetermined amount of ink is used the first urging/pulling device is mechanically released with the use of deformation or movement of the walls of the ink pack. After the first: urging/pulling device is released, the second urging/pulling device is employed to apply appropriate urging/pulling forces to the ink pack. Therefore, the appropriate urging/pulling forces are applied regardless of the amount of ink used, applying negative pressures appropriate for printing, to the ink.

The releasing device includes a guide member to guide the positional change of the engagement portion.

Since the guide member guides the engagement portion, and regulates the path of the engagement portion according to the amount of ink used, the distance from the supporting points of the first urging/pulling device to the engagement portion is accurately regulated according to the amount of ink used, and the first urging/pulling device can be released at the right time when the predetermined ink is used.

Furthermore, the releasing device includes the guide member to guide the end of the engagement catch.

Since the engagement catch changes its position with the end of the engagement catch regulated by the guide member, the first urging/pulling device can be released at the right time when the predetermined ink is used.

The second urging/pulling device urges/pulls the ink pack with the elasticity of the ink pack.

Since the second urging/pulling device uses the elasticity of the ink pack, other urging/pulling mechanisms do not have to be provided. Therefore, the compact design of the ink cartridge can be pursued.

The ink pack is urged/pulled with the rigidity and strength on the walls increased by the lamination of a plurality of synthetic resin films.

Since the rigidity and strength of the walls of the ink pack are increased by the lamination of a plurality of synthetic resin films, the appropriate negative pressures can be applied to the ink to be supplied.

The second urging/pulling device urges/pulls the ink pack by a plate spring attached to the ink pack.

Since the plate spring is used to urge/pull the ink pack, the appropriate urging/pulling forces can be applied regardless of the ink pack material by flexibly adjusting the elasticity of the plate spring.

In the ink cartridge of the invention, a plurality of ink packs are provided.

Since a plurality of ink packs are provided, it can accommodate a printing apparatus that performs color printing or that produces various tones of colors.

The housing has an ink extracting portion having a rubber member into which a hollow ink extracting needle is inserted to extract the ink from the ink pack contained in the housing.

Therefore, it becomes possible to extract the ink from the ink pack via the ink extracting needle, and the constriction of the ink pack can be simplified. Furthermore, even if the ink is leaked out of the portion where the ink extracting needle is inserted, the ink extracting portion having the rubber member prevents the ink from leaking out of the ink cartridge, so that the printing apparatus or its users will not be soiled with the ink.

The ink is supplied to an ink jet print head included in an image forming apparatus.

The liquid ink whose pressures are kept at the appropriate negative pressures can be supplied to an ink jet print head which is easily affected especially by the negative pressures of the liquid ink to be supplied. Therefore, the meniscuses can be properly formed, producing the high-quality images.

In the ink cartridge of the invention, the ink is supplied to the ink jet print head via a tube.

Since appropriate negative pressures are applied to the liquid ink despite the pressures attributable to the height differences between the bag of the ink pack and the ink jet print head, the liquid ink whose pressures are kept at the appropriate pressures, can be supplied from the bag of the ink pack to the ink jet print head via the tube. Therefore, high-quality images can be produced.

BRIEF DESCRIPTION OF THE DRAWINGS

The preferred embodiments of the invention will be described in detail with reference to the following figures wherein.

DETAILED DESCRIPTION OF PREFERRED EMBODIMENT

Figure 2:
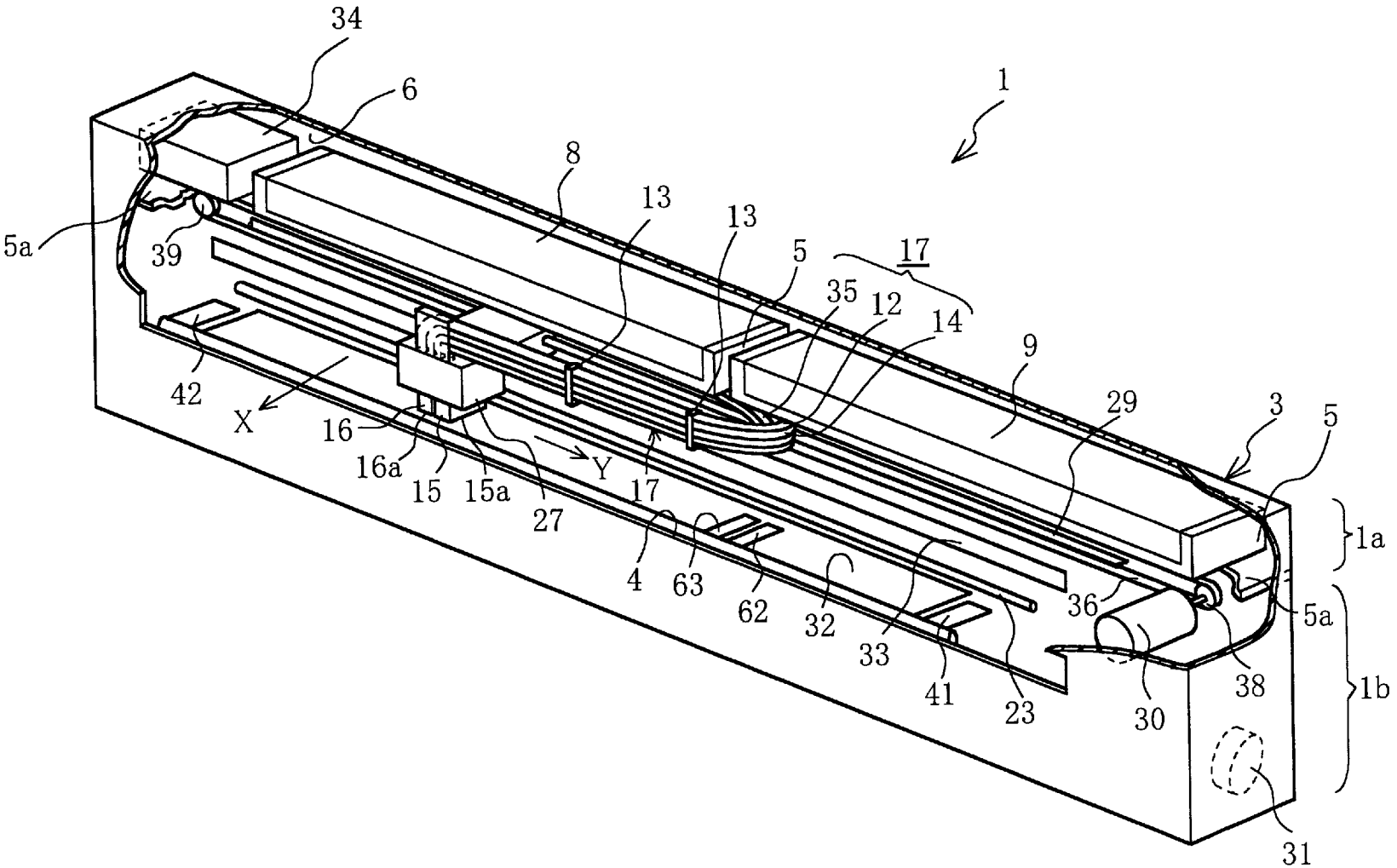
FIG. 2 is a partially cutaway perspective view of the portable printer for schematic illustration of an internal structure of the printer.

A first preferred embodiment embodying the invention will be explained referring to the figures. FIG. 2 is a partially cutaway perspective view of a portable printer for schematic illustration of an internal structure of the printer 1. As shown in FIG. 2, the portable printer 1 includes a large ink cartridge 8 and a small ink cartridge 9 (hereinafter, collectively referred to as the "ink cartridges 8, 9") disposed at predetermined positions. The portable printer 1 performs printing by supplying ink from the ink cartridges 8, 9 to a right-side print head 15 and a left-side print head 16 (hereinafter, collectively referred to as the "print heads 15, 16"), and ejecting ink from right-side nozzles 15*a* and left-side nozzles 16*a* (hereinafter, collectively referred to as the "nozzles 15*a*, 16*a*") arranged in the print heads 15, 16, while reciprocatingly moving a carriage 27 on which the print heads 15, 16 are mounted, in main scanning directions perpendicular to the direction of sheet conveyance.

Figure 1:
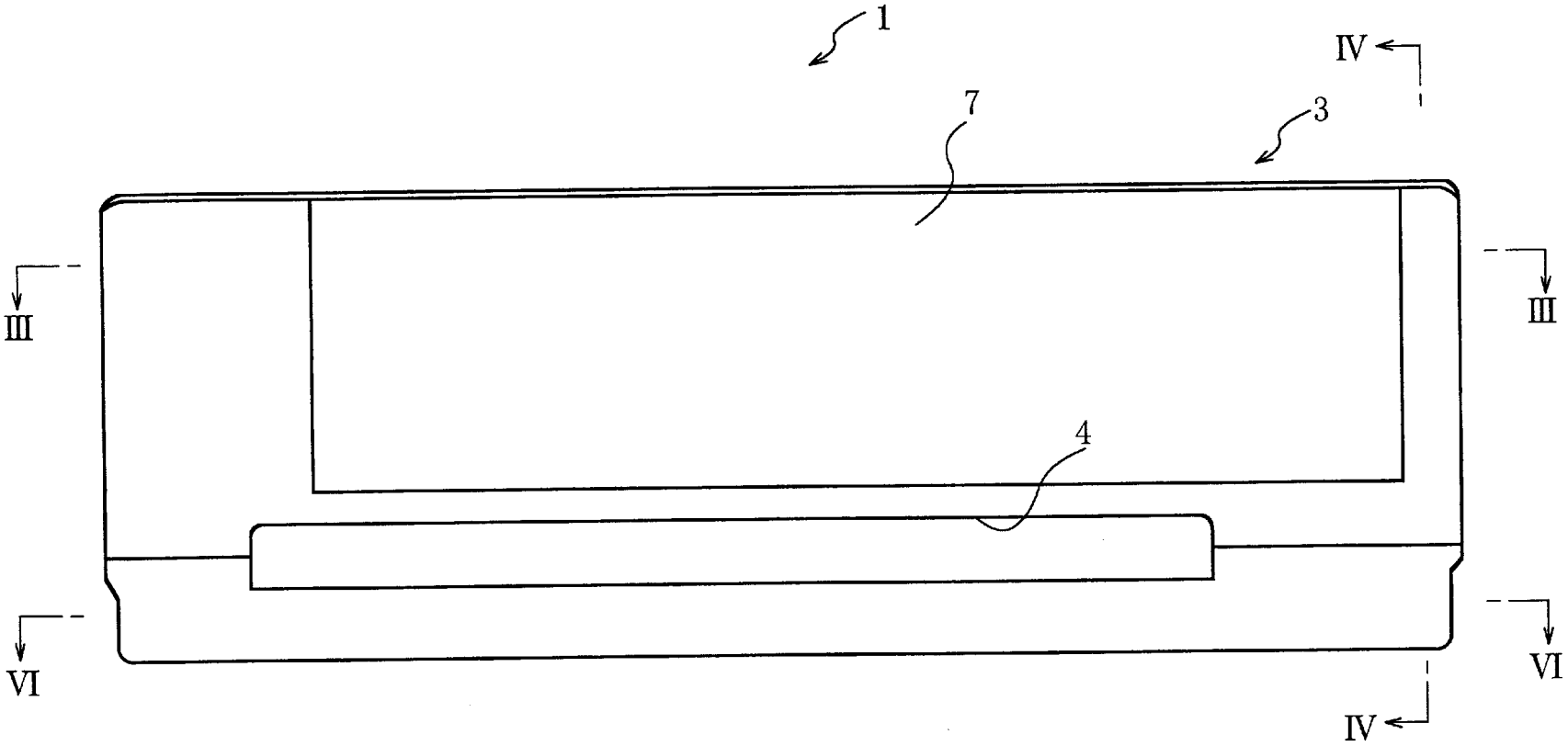
FIG. 1 is a front view of an exterior of a portable printer according to an embodiment of the invention.

FIG. 1 is an external front elevation of the portable printer 1 according to the embodiment of the invention. As shown in FIG. 1, the portable printer 1 has a printer body 3 which is a case having a generally rectangular box shape. A sheet discharge opening 4 having a generally rectangular shape that is elongated in the longitudinal direction of the portable printer 1 (right-to-left direction in FIG. 1), is formed in a substantially center portion in a lower portion of the printer body 3. The sheet discharge opening 4 is an opening to discharge the print sheet PP after printing. The elongated width of the sheet discharge opening, that is, the dimension thereof in the longitudinal direction of the portable printer 1, is defined corresponding to the width of the print sheet PP. In the portable printer 1 of the embodiment, the elongated width of the sheet discharge opening 4 is greater than the width of the A4-size sheets (approx. 210 mm). An upper portion of the portable printer 1 has a lid for replacement of the ink cartridges 8, 9.

In FIG. 2, an arrow X indicates the direction of conveyance of the print sheet PP and an arrow Y indicates the moving direction of the print heads 15, 16 during main scanning.

The printer body 3 also serves as a body frame 6 having a generally rectangular box shape. Generally rectangular shelf-shaped cartridge frames 5 are disposed in an upper space 1*a* of the body frame 6. A partition plate 5*a* extends below the cartridge frame 5 throughout substantially the entire length of the body frame 6 along the rearward side thereof, separating the upper space 1*a* from a lower space 1*b*. The partition plate 5*a* defines an opening in front thereof, whereby the upper space 1*a* communicates with the lower space 1*b*. The ink cartridges 8, 9 are arranged horizontally on the cartridge frame 5 positioned over the partition plate a, with their upper surfaces being flush with one another.

Disposed in the lower space 1*b* of the body frame 6 of the portable printer 1 is the carriage 27 which reciprocatingly moves within the printer body 3 toward and away from arrow Y, that is, in the main scanning directions. The carriage 27 carries thereon the print heads 15, 16 aligned in the main scanning directions, and the print heads 15, 16 eject ink for printing. The right-side print head 15 is provided with the right-side nozzles 15*a* arranged along the lower surface of the head. More specifically, the nozzle 15*a* define two rows of many nozzles openings that are arranged in the sheet conveyance direction X, and each nozzle opening is equipped with a piezo-electric element.

The nozzle openings in one of the two row are filled with magenta ink supplied from a corresponding ink bag of a large ink pack of the large ink cartridge 8. The nozzle openings in the other row are filled with black ink supplied from a corresponding ink bag of the large ink pack. Similarly, the left-side print head 16 is provided with the left-side nozzles 16*a* arranged along a lower surface of the head, and each nozzle opening is filled with a yellow or a cyan ink. Then, yellow, magenta, cyan, and black is ejected from the rows of the nozzle openings to perform color printing.

When the voltage is applied to the nozzles 15*a*, 16*a* equipped with piezo-electric elements, the changes in shapes of the nozzles 15*a*, 16*a* occur in proportion to the applied voltage, and the nozzles 15*a*, 16*a* flex. The flexing nozzles 15*a*, 16*a* eject ink from the nozzle openings onto the print sheet PP, thus performing printing.

The two generally rectangular box-shaped ink cartridges 8, 9 are detachably disposed in a horizontal posture on the cartridge frame 5 within the upper space 1*a* of the portable printer 1, that is, above the print heads 15, 16.

Of the ink cartridges 8, 9, the large ink cartridge 8 disposed on the left side in FIG. 2 houses two ink packs containing ink which are to be ejected from the right-side print head 15. One ink pack contains the magenta ink, and the other contains the black ink. A lower portion of the large ink cartridge 8 has a waste ink reservoir 8*b* that holds waste ink sucked by a purge operation (described below) to prevent the nozzles of print heads 15, 16 from being clogged with ink.

Immediately to the right of the large ink cartridge 8 in FIG. 2, the small ink cartridge 9 is detachably disposed in a horizontal posture with the upper surface thereof being flush with that of the large ink cartridge 8. Similar to the large ink cartridge 8, the small ink cartridge 9 houses two ink packs 9*a* containing ink which are to be ejected from the left-side print head 16. One ink pack 9*a* contains the yellow, and the other contains the cyan ink. The small ink cartridge 9 and the small ink pack 9*a* are smaller than the large ink cartridge 8 and the large ink pack, respectively. That is, the amount of ink contained is less in the small ink pack 9*a* than in the large ink pack. More specifically, each large ink pack is capable of containing 8 ml of ink whereas each small ink: pack 9*a* is cable containing only 5.5 ml of ink. The capacities of ink pack are thus set because of different ink ejection amounts of nozzles 15*a*, 16*a* of the print heads 15, 16.

Figure 9:
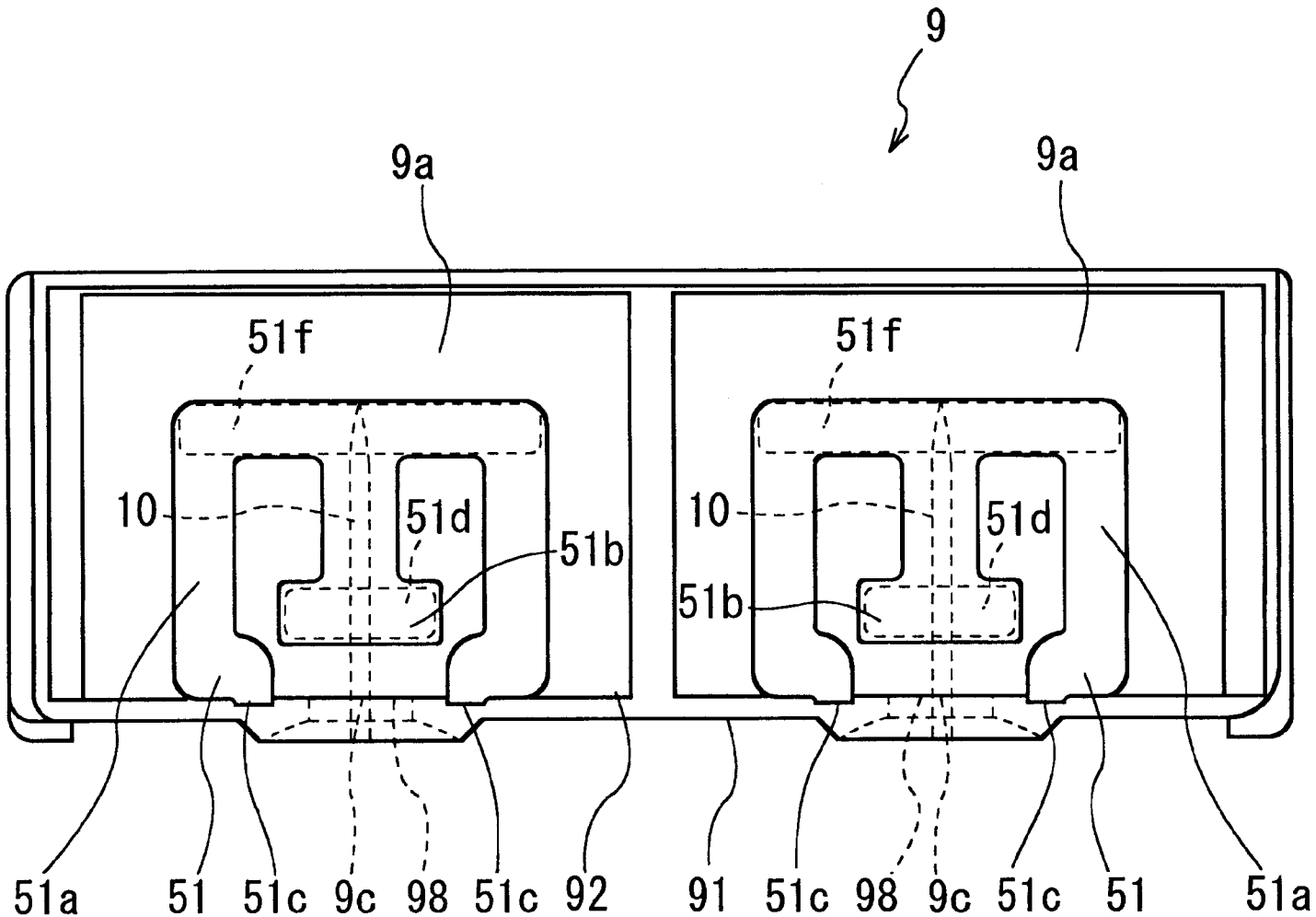
FIG. 9 is a plan sectional view of the small ink pack 9*a* taken on line Z—Z of FIG. 4, viewed from the upper side of the small ink pack 9*a;*

The structure common to the ink cartridges 8, 9 will be described in detail taking the small ink cartridge 9 as an example. FIG. 9 is a schematic sectional view of the small ink cartridge 9 taken on line Z—Z of FIG. 4, viewed from the upper side of the small ink pack 9*a*. A lid of the cartridge body is omitted from the illustration. As shown in FIG. 9, the small ink cartridge 9 is covered with the cartridge body 91 that has a hollow rectangular box shape and is formed from rigid synthetic resins such as polypropylene. The cartridge body 91 has an ink pack housing 92 therein that contains two bags of the small ink packs 9*a*. Provided in the side surface in the longitudinal direction of the cartridge body 91 are two extraction openings 98. The extraction opening 98 is a portion where the ink extracting needle 10 is inserted and has a cylindrical opening into which a disk-shaped rubber plate is fixedly inserted. The rubber plate is pricked with a sharp pointed end of the ink extracting needle 10. The ink extracting needle 10 is further inserted into an insert portion 9*c* of the small ink pack 9*a* to extract the ink from the small ink pack 9*a* via an extracting hole 10*a* provided at the end of the hollow ink extracting needle 10.

Figure 15A:
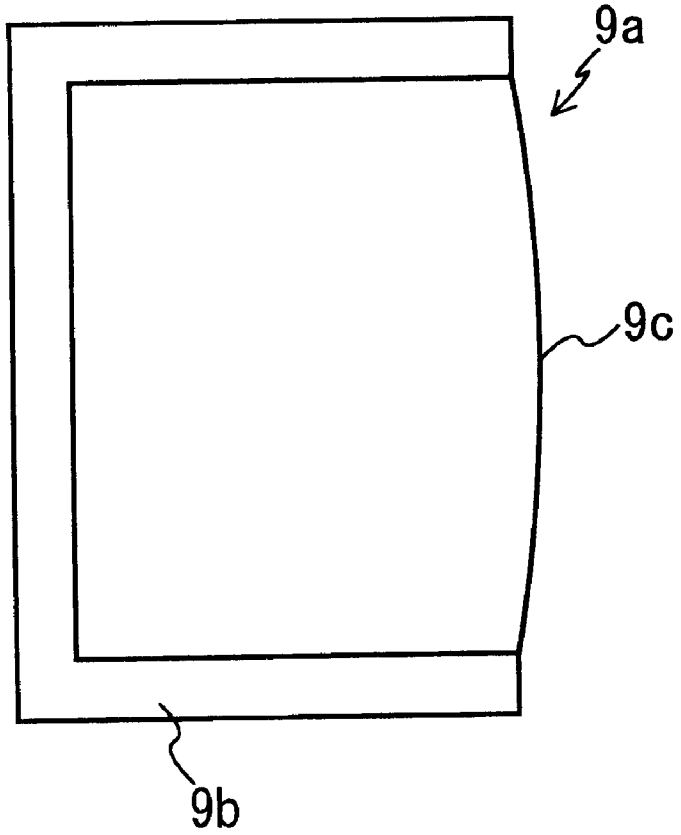
FIG. 15A is a plan view of the small ink pack 9*a;*
Figure 15B:
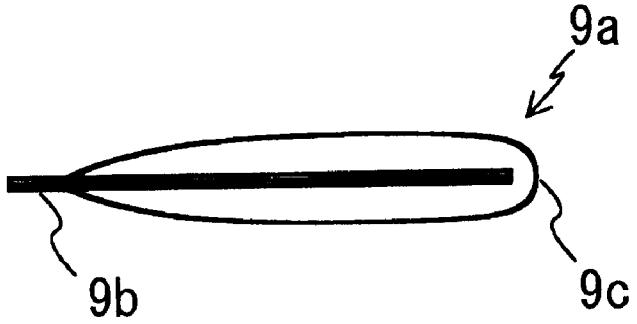
FIG. 15B is a side view of the small ink pack 9*a;*

FIG. 15A is a plan view of the small ink pack 9*a* housed in the ink pack housing 92. FIG. 15B is a side view of the small ink pack 9*a*. As shown in FIG. 15A, the ink packs, 9*a* housed in the ink cartridges 8, 9 are formed by generally rectangular-shaped bags. Each ink pack, 9*a* is formed by a laminate film material obtained by laminating a plurality of film sheets, for example, approximately 10 film sheets of polyethylene resin or the like. The film sheets are folded in half and its circumference is welded by head to tightly seal ink therein. Sealed portions 9*b* are provided at the upper, lower, and left sides of FIG. 15A. Near the substantially center of the right-side portion of FIG. 15A which is not the sealed portion 9*b*, the insert portion 9*c* where the ink extracting needle 10 is inserted is provided. The insert portion 9*c* does not have any special devices, but due to the elasticity of resin of the bags of the small ink pack 9*a*, the film material around the ink extracting needle 10 inserted into the small ink pack 9*a* sticks to the ink extracting needle 10. Therefore, the ink will not be leak from the small ink pack 9*a*.

Figure 7A:
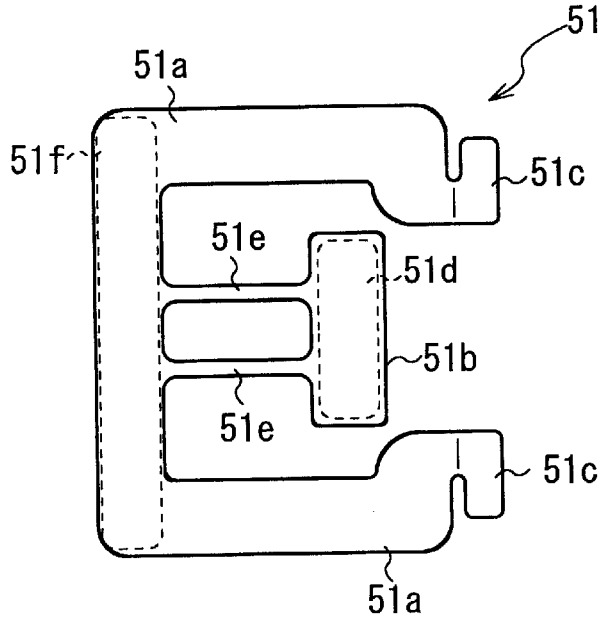
FIG. 7A is a plan view of the upper supporting spring 51.
Figure 7B:
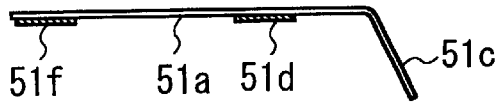
FIG. 7B is a side view of the upper supporting spring 51.

FIG. 7A is the plan view of the upper supporting spring 51. FIG. 7B is a side view of the upper supporting spring 51. As shown in FIG. 7A, the upper supporting spring 51 is formed by punching and bending an elastic plate spring made of a thin plate of stainless steel. The upper supporting spring 51 has a substantially E- or C-shaped outer portion 51*a*, a fixing portion 51*c*, central supporting portions 51*e*, and a central portion 51*b*. As shown in FIG. 7B, the fixing portion 51*c* is a pair of protruding portions bent so as to be fixedly inserted into the slits (not shown) on the cartridge body 91. The central supporting portions 51*e* are narrow plates parallel to each other, extending toward the fixing portions 51*c* from the substantially center of the inner surfaces of the outer portion 51*a*. The central portion 51*b* has a generally rectangular shape and is supported by the central supporting portions 51*e*.

Double-sided adhesive tape 51*f* is applied to the bottom surfaces of the central portion 51*b* and the side of the outer portion 51*a* opposite to the fixing portions 51*c*. The double-sided adhesive tape 51*f* is affixed to the upper surface of the small ink pack 9*a*.

As shown in FIG. 9, the small ink pack 9*a* is housed in the ink pack housing 92 so that the insertion portion 9*c* faces and contacts the extraction opening 98. To the top surface of the small ink pack 9*a*, the upper supporting spring 51 is attached with the double-sided adhesive tape 51*f* applied to a side of the outer portion 51*a* and the central portion 51*b* of the upper supporting spring 51. The upper supporting spring 51 is fixed by inserting the fixing portions 51*c* into the slit (not shown) provided on the inner side of the cartridge body 91.

Figure 10:
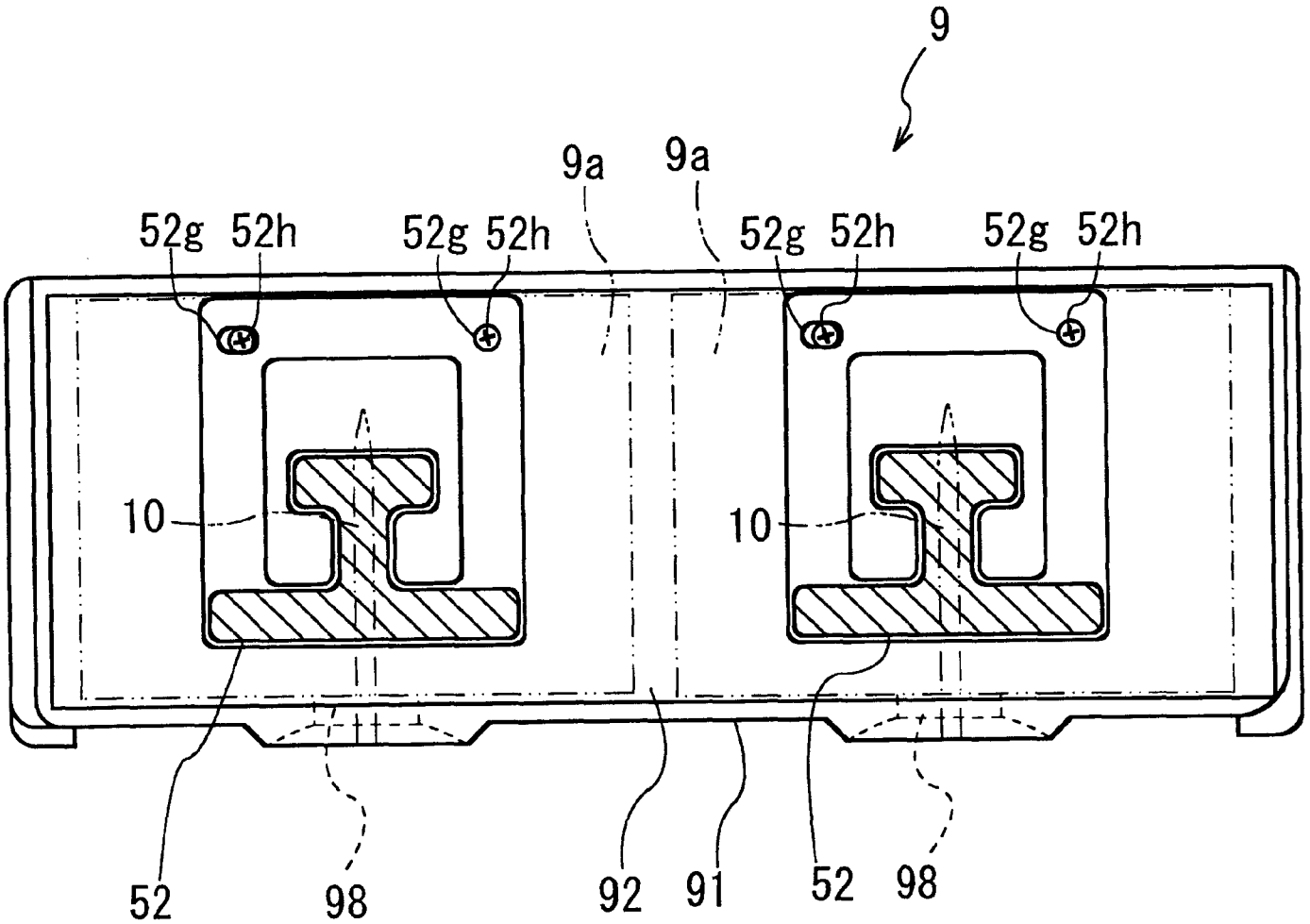
FIG. 10 is a plan sectional view of the small ink cartridge 9 wherein the small ink pack 9*a* and the upper supporting spring 51 are removed from the state shown in the FIG. 9.

FIG. 10 is a plan view of the small ink cartridge 9 wherein the small ink pack 9*a* and the upper supporting spring 51 are removed from the state shown in FIG. 9. As shown in FIG. 10, the lower supporting spring 52 is disposed under the small ink pack 9*a*.

Figure 8A:
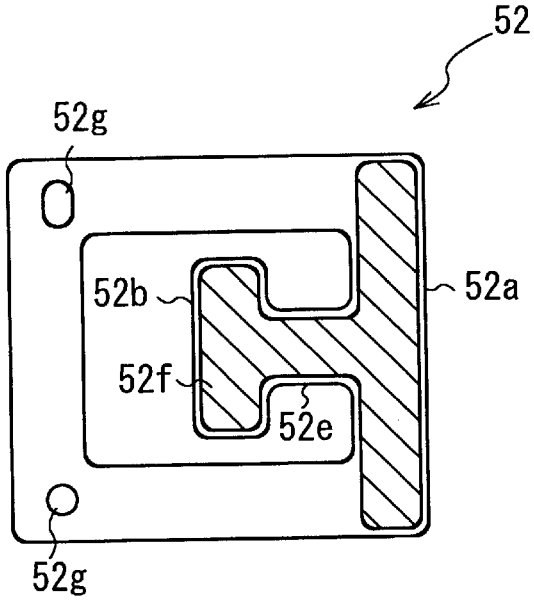
FIG. 8A is a plan view of the lower supporting spring 52.
Figure 8B:
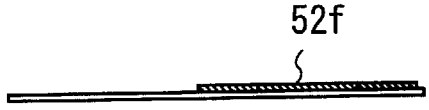
FIG. 8B is a side view of the lower supporting spring 51.

FIG. 8A is a plan view of the lower supporting spring 52. FIG. 8B is a side view of the lower supporting spring 52. Similar to the upper supporting spring 51, the lower supporting spring 52 is formed from a thin plate of stainless steel. The lower supporting spring 52 has a generally O- or square-shaped outer portion 52*a*, screw holes 52*g*, a central supporting portion 52*e*, and a central portion 52*b*. The screw holes 52*g* are provided near the corners on one side of the lower supporting spring 52. The central supporting portion 52*e* is a plate extending from the inner surface of a side opposite to the one having screw holes 52*g*. The central supporting portion 52*e* supports the central portion 52*b*.

The double-sided adhesive tape 52*f* is applied to the upper surface of a side of the outer portion 52*a* opposite to the side having the screw holes 52*g*, the central portion 52*b*, and the central supporting portion 52*e* that connects the side of the outer portion 52*a* opposite to the side having the screw holes 52*g* and the central portion 52*b*. That is, to the side facing to the small ink pack 9*a*, the adhesive tape 52*f* is applied.

As shown in FIG. 10, the lower supporting spring 52 is fixed to the lower surface of the ink pack housing 92 of the cartridge body 91, by inserting two tapping screws 52*h* into the each of two screw holes 52*g*.

As shown in FIG. 2, the ink cartridges 8, 9 are disposed above the print heads 15, 16 that supply ink to the print heads 15, 16. Since the large ink cartridges 8 and the small ink cartridges 9 are horizontally disposed at the same height, the ink packs 9*a* in the ink cartridges 8, 9 are disposed on a single horizontal plane. The nozzles 15*a*, 16*a* of the print heads 15, 16 are also located in the single horizontal plane. Therefore, the ink pack 9*a* of four color inks and the corresponding nozzles have equal height differences. Due to the equal height differences, the hydraulic pressures on the nozzles become equal and constant, so that color ink nozzles have a uniform internal pressure and therefore the ink can be supplied uniformly.

The ink pressure supplied to the print heads 15, 16 is kept at a uniform negative pressure, so that the each nozzle opening of the nozzles 15*a*, 16*a* have a concave meniscus of ink liquid. Since the internal pressure in the print heads 15, 16 is uniformly maintained, ink ejection characteristics of the nozzles 15*a*, 16*a* of the print heads 15, 16 can be maintained, so that good print quality can be maintained. In the case of the print heads 15, 16 of this embodiment, for example, a concave meniscus of ink can be formed in each nozzle opening (not shown) of the nozzles 15*a*, 16*a* if the supplied ink pressure is within the range (operating pressure range) of approx. 0 mmAq to approx. −300 mmAq (water column) relative to the atmospheric pressure. The optimum operating pressure range of the print heads 15, 16 for print operation by the portable printer 1 of this embodiment, is from approx. 0 mmAq to approx. −100 mmaq (water column) relative to the atmospheric pressure. In this embodiment, the height difference between the nozzles 15*a*, 16*a* of the print heads 15, 16 and the ink packs 8*a*, 9*a* is approx. 60 mm, and the negative pressures inside the ink packs 8, 9 is required to be within the range of approx. −90 mmAq to approx. −160 mmAq (water column). By the use of the upper supporting spring 51 and the lower supporting spring 52, the internal pressures are adjusted at appropriate negative pressures.

A control unit 34 having a CPU, an input buffer memory, a head driving IC, and the like is disposed to the left side of the ink cartridges 8, 9 in the upper space 1*a* of the portable printer 1 in FIG. 2. Four flexible printed cables (FPCs) 35 that apply voltages to the print heads are connected to the control unit 34. The four head driving FPCs 35 are stacked near the rearward end portion of the control unit 34 (an end portion toward the rear side in FIG. 2) in the upper space 1*a* of the portable printer 1. The head driving FPCs 35 are then laminated on the forward side (in FIG. 2) of ink supply tube 12 (described below) near the rear end portion of the large ink cartridge 8 (an end portion toward the rear side in FIG. 2) in the upper space 1*a* of the portable printer 1, and connected to the upper portions of the print heads 15, 16. The ink supply tubes 12 are stacked vertically and connected to the ink cartridges 8, 9. The head driving FPCs 35 are film-like cables formed by forming electrically conductive wiring patterns on a polyimide substrate and covering the wiring patterns with a protective layer.

Figure 4:
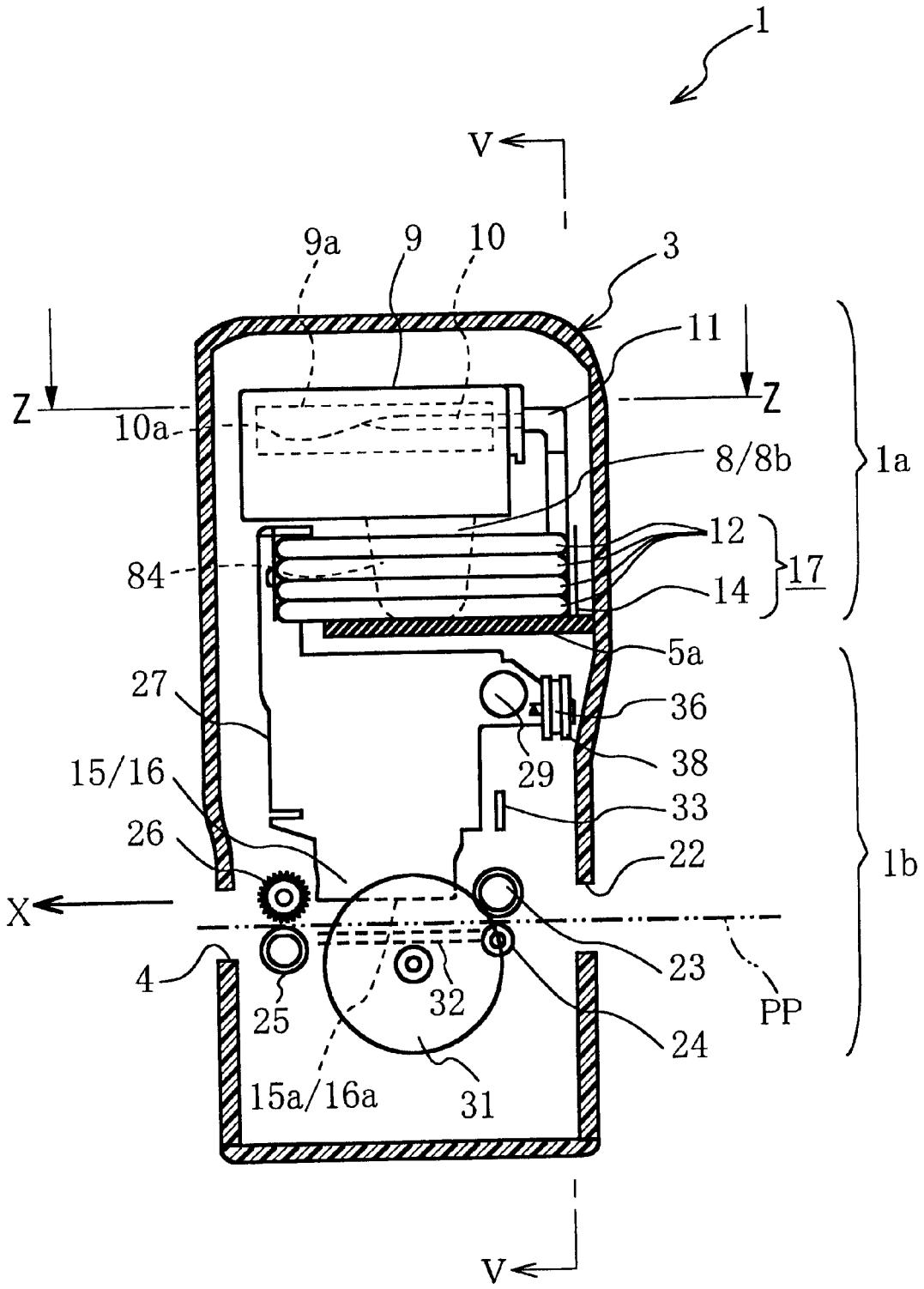
FIG. 4 is a schematic partial sectional view of the portable printer taken on line IV—IV of FIG. 1, viewed from the right-side end of the portable printer.

FIG. 4 is a schematic partially sectional view of the portable printer 1 taken on line IV—IV of FIG. 1, wherein a carriage (CR) motor 30 is omitted to simplify the illustration. As can been seen in an upper portion of the drawing of FIG. 4, the ink extracting needles 10 for the individual color inks are inserted into the ink packs 8*a*, 9*a* housed in the ink cartridges 8, 9. The ink extracting needles 10, provided for extracting inks from the ink packs 8*a*, 9*a* are formed from corrosion-resistant metallic materials, such as stainless steels and ceramic materials. Each ink extracting needle 10 is a hollow needle having in its distal end portion (the left-side end portion in FIG. 4) an extracting hole 10*a* that extracts an ink from the ink packs 8*a*, 9*a*. The extracting hole 10*a* of each ink extracting needle 10 is in communication with an internal space of the needle. Therefore, when the ink extracting needles 10 are inserted into the ink packs 8*a*, 9*a*, ink can flow from the ink packs 8*a*, 9*a* into the internal spaces of needles via the ink extraction hole 10*a*.

In the large ink cartridge 8, a charging needle 70 that charges waste ink sucked by the purge operation (described below) and conducted to the charging needle 70 via a waste ink tube 66 (see FIG. 6), is disposed into a first waste ink chamber 83.

As shown in FIG. 4, a base end portion of each ink extracting needle 10 (an end portion opposite to the tip end thereof, that is, an end portion in the right side in FIG. 4) inserted into the corresponding one of the ink pack 9*a* of the four colored ink, is coupled to an end of a generally "L"-shaped coupling member 11, near the rear end of the upper space 1*a* of the portable printer 1 (the right side end thereof in FIG. 4). The other end of each coupling member 11 is connected to the corresponding one of the ink supply tubes 12. Each coupling member 11 has a hollow tubular shape, in which a communication hole (not shown) is formed to communicate with the ink extracting hole 10*a* of the corresponding one of the ink extracting needles 10. The ink supply tubes 12 are generally hollow cylindrical flexible tubes formed from a synthetic resin such as polypropylene, polyurethane, polyurethane, and polyvinyl chloride. The ink supply tubes 12 allow ink to flow therethrough in order to supply ink to the print heads 15, 16.

In the embodiment, each ink supply tube 12 is formed by a TYGON® tube manufactured by NORTON. The wall thickness thereof is within the range of approx. 0.5 mm to approx. 1.5 mm, the tube inside diameter is within the range of approx. 0.5 mm to approx. 1.5 mm. The ink supply tubes 12 in the embodiments, as for example, is a TYGON tube having the wall thickness of approx. 0.8 mm, an inside diameter of approx. 0.8 mm, and an outside diameter (equal to the sum of twice the wall thickness and the inside diameter) of approx. 2.4 mm. The minimum value of the radius R of curvature (minimum radius of curvature) of the ink supply tubes 12 in a bent state is approx. 20 mm.

The four ink supply tubes 12 will be further described with reference to FIGS. 2 and 4. Near a substantially central portion of the rear end portion (far end side in FIG. 2) of the upper space 1*a* of the portable printer 1, the ink supply tubes 12 connected to ink packs 9*a* are stacked and bundled into a vertical row by elongated rectangular annular shaped binders (not shown). The four head driving FPCs 35 stacked and connected to the control unit 34 are placed and attached onto the inward side of the curved ink supply tubes 12, that is, the forward side of a far-side portion thereof. The outward side of the curved ink supply tubes 12, that is, the rearward side of a far-side portion thereof, is covered with a protective film 14 that protects the ink supply tubes 12 from the interference with the body frame 6.

The protective film 14 is a protective member for ensuring smooth sliding of the ink supply tube 12 on an inner wall of the body frame 6. The protective film 14 is normally a film formed from a material that achieves a low surface adhesion or tackiness. The protective film 14 needs to be able to support itself or retain its shape and also needs to be able to bend together with the ink supply tube 12 and head driving FPCs 35 so as to follow the movement of the print heads 15, 16. The thickness of protective film 14 is preferably within the range of approx. 25 mvm to 300 mm. In this embodiment, the protective film 14 is formed by a polyethylene terephthalate (PET) film having a thickness of approx. 100 m.m.

The head driving FPCs 35, the ink supply tubes 12 and the protective film 14 are laminated in that order from the near side in FIG. 2, at a location near a substantially central portion of the rear end portion (far side in FIG. 2) of the upper space 1*a*. These members are bundled together at predetermined intervals by generally angled "8"-shaped binders 13, each of which has a wide opening and a narrow opening. The narrow opening of each binder 13 closely contacts and firmly holds the four stacked ink supply tubes 12 so as to retain the stack. The wide opening of each binder 13 is approximately four to five times as wide as the narrow opening. The wide opening of each binder 13 bundles the four head driving FPCs 35 so that the bundle of the head driving FPCs 35 is not greatly apart from the bundle of the four ink supply tubes 12. The wide opening of each binder 13 allows the head driving FPCs 35 to substantially freely slide therein. Therefore, the binders 13 secure an appropriate space that allow the head driving FPCs 35 to escape inward when the two bundles are bent, so that the bending thereof will not be impeded but can easily be performed. The protective film 14 is disposed on the outside of each binder 13 so as to cover the ink supply tubes 12.

The four ink supply tubes 12 and the four head driving FPCs 35 are bundled by the binder 13 at intervals of approx. 5 cm. The two bundles are bent from a rightward orientation toward the near-side end of the portable printer 1 in FIG. 2 on a plane of the partition plate 5*a* while the stacks of bundles are maintained. At a location near the forward end portion of the upper space 1*a* (the near side thereof in FIG. 2) of the portable printer 1, the bundles are bent toward the print heads, that is, leftward in FIG. 2 since the print heads 15, 16 are at an initial position that is shown leftward. The bundles are then connected to a connecting portion provided in an upper portion of the print heads 15, 16. The four color inks are conducted to the designated print heads 15, 16 via the corresponding ink supply tubes 12.

The ink supply tubes 12 are vertically stacked and bundled by the binder 13. This arrangement prevents the ink supply tubes 12 from hanging or bending down (downward in FIG. 2) due to gravity. Furthermore, the partition wall 5*a* disposed below the ink supply tubes 12 supports the four ink supply tubes 12 from below, thereby preventing the ink supply tubes 12 from hanging or bending down due to gravity. Further, the ink supply tubes 12 are substantially sandwiched by the elastic protective film 14 and the elastic head driving FPCs 35, so that the stack of the ink supply tubes 12 are prevented from bending at sharp angles, except for the aforementioned curved portion of the stack. This arrangement prevents an undesired event that the stack of the ink supply tubes 12 folds or bends at a sharp angle so that the inward sectional area of the ink passages decreases and an energy loss of the inks flowing through the ink supply tubes 12 occur. Still further, the sandwich arrangement with the elastic members also prevents an undesired bend of the bundle of the ink supply tubes 12 on a protrusion 84 (shown in FIG. 4) of the waste ink reservoir 8*b* of the large ink cartridge 8, which is located inside the curve of the bundles of the ink supply tubes 12 and the head driving FPCs 35.

Figures 3A, 3B, 3C:
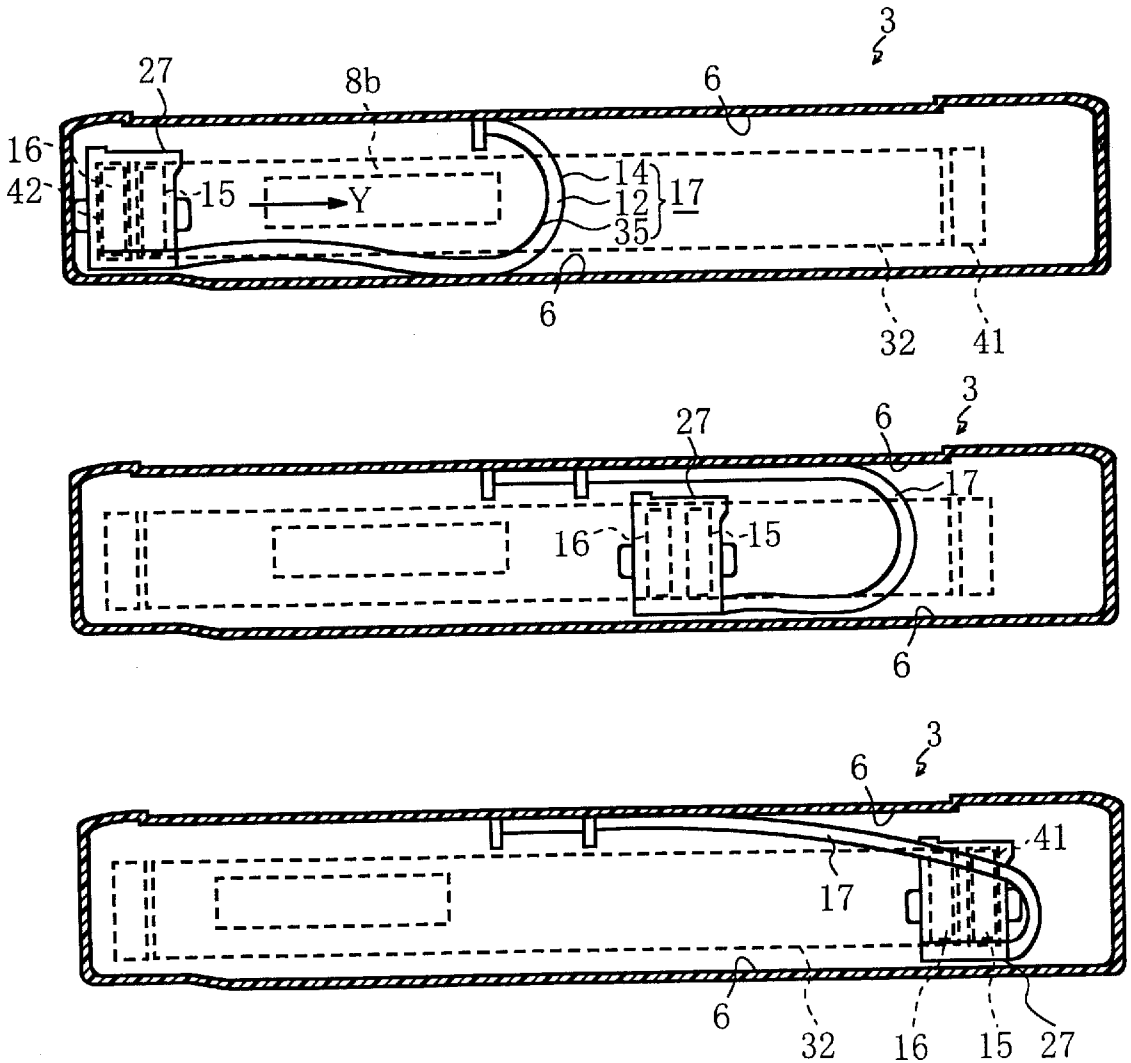
FIG. 3A is a plan sectional view of the portable printer taken on line III—III of FIG. 1, illustrating a state assumed by a harness as print heads move, wherein a carriage is at the leftmost position.
FIG. 3B is a plan sectional view of the portable printer similar to the sectional view of FIG. 3A, wherein the carriage is at an intermediate position.
FIG. 3C is a plan sectional view of the portable printer similar to the sectional view of FIG. 3A, wherein the carriage is at the rightmost position.

The collective bundles of the protective film 14, the stack of the ink supply tube 12, and the stack of the head driving FPC will hereinafter be referred to simply as "harness 17". FIGS. 3A, 3B and 3C are plan sectional views of the portable printer 1 taken along the line III—III of FIG. 1, illustrating different states of the harness 17 assumed as the print heads 15, 16 moves. In FIGS. 3A to 3C, unrelated portions are omitted from the illustration. As shown in FIGS. 3A to 3C, the harness 17 extends from the substantial central portion of the rear end portion of the upper space 1*a* (far side in FIG. 2), and connects to the upper portion of the print heads 15, 16. In FIGS. 3A to 3C, the direction indicated by an arrow Y is a main scanning direction.

FIG. 3A shows a state that the print heads 15, 16 are at the initial position before printing, that is, the right-side print head 15 is at the left-side end of a platen that defines the printing area. In the state shown in FIG. 3A, the print heads 15, 16 are at a leftmost position in the drawing. In this state, the left-side print head 16 is positioned over the left-side flushing area 42. In this state, the protective film 14 is pressed against the forward wall of the body frame 6 (lower side thereof in FIG. 3A) since the harness 17 tends to straighten due to its elasticity. When the CR motor 30 is operated upon the application of a voltages, and therefore moves the carriage 27 together with the print heads 15, 16 as shown in FIG. 2, from the aforementioned state to the right, that is, in the main scanning direction Y, the harness 17 connected to the print heads 15, 16 is also moved following the movement of the print heads 15, 16. In this case, the harness 17 moves while pressing the protective film 14 against the forward wall (lower side in FIG. 3A) of the body frame 6 so that the protective film 14 slides on the forward wall of the body frame 6.

FIG. 3B shows a state that the carriage 27 has been moved in the direction Y. In this state, the harness 17 has progressively moved to the rearward wall (upper side in FIG. 3B) of the body frame 6, and therefore the length of the curved portion has decreased so that the harness 17 is now out of the sliding contact with the forward wall (lower side in FIG. 3B) of the body frame 6. Therefore, the movement resistance of the carriage 27 has decreased, the load on the CR motor 30 has decreased.

FIG. 3C shows a state that the carriage 27 has been further moved in the direction Y to the rightmost position. In this state, the right-side print head 15 is positioned over the right-side flushing area 41. In this state, the harness 17 is apart from the forward wall (lower side in FIG. 3C) of the body frame 6, so that no sliding resistance occurs in respect to the forward wall of the body frame 6.

Although the foregoing embodiment pursues a compact design of the print heads by providing rows of nozzle openings for two colors in each print head, it is also possible to provide rows of nozzle openings for the color ink in respective print heads. Selecting one of these print head structures is based on the balance between the production costs and compact design requirements. Therefore, the number of heads employed is not limited to two, but may also be more than two.

In FIG. 4, an arrow X indicates the print sheet PP conveying direction. As shown in FIG. 4, a insert opening 22 to insert unused print sheets PP, is formed in the rearward lower portion (right side in FIG. 4) of the printer body 3. Disposed downstream of the insert opening 22 in the direction of conveyance of each print sheet PP inserted into the insert opening 22 are a conveying roller 23 that conveys each print sheet PP and a pressure roller 24 that presses the print sheet PP against the conveying roller 23. The conveying roller 23 is driven by a line feed (LF) motor 31. The conveying roller 23 and the pressure roller 24 cooperate to convey each print sheet PP while pressing and clamping the sheet.

Disposed downstream of the conveying roller 23 and the pressure roller 24 are a discharge roller 25 driven by the LF motor 31 to discharge the print sheet PP conveyed from the conveying roller 23 out of the printer body 3, and a pressure roller 26 that presses the print sheet PP against the discharge roller 25. The discharge roller 25 and the a pressure roller 26 cooperate to discharge each print sheet PP via the sheet discharge opening 4.

The print heads 15, 16 are disposed over the print sheet PP positioned between the conveying roller 23 and the discharge roller 25. The print heads 15, 16 are detachably mounted on the carriage 27 which reciprocatingly moves in the directions substantially perpendicular to the sheet of the drawing of FIG. 4, that is, the direction indicated by the arrow Y in FIG. 2 and the opposite direction, along the guide bar 29 supported by the body frame 6 of the printer body 3. The surfaces of the print heads 15, 16 facing the print sheet PP have the nozzles 15*a*, 16*a* that eject the ink to the print sheet PP held by the conveying roller 23 and the like.

The carriage 27 on which the print heads 15, 16 are mounted will be explained with reference to FIGS. 2 to 4. The carriage 27 positioned in the lower space 1*b* is supported by the guide bar 29, which extends through a rear portion of the carriage 27 (right-side portion thereof in FIG. 4) in the main scanning direction. The carriage 27 is movable in the main scanning direction, guided by the guide bar 29. A driving pulley 38 is connected to a rotating shaft of the CR motor 30 disposed at the right-side end in FIG. 2. The driving pulley 38 and a following pulley 39 disposed at the left-side end in FIG. 2 are connected by a timing belt 36. The carriage 27 is fixed by a portion of the timing belt 36. When a voltage is applied to the CR motor 30 by the control unit 34, the CR motor 30 operates to rotate the driving pulley 38 and therefore the timing belt 36. In this manner, the carriage 27 is moved along the guide bar 29 in the main scanning direction (the direction of the arrow Y in FIG. 2 and the opposite direction). A timing fence 33 that recognizes the position of the carriage 27 is provided on the rear side of the carriage 27 (the right side thereof in FIG. 2)

Figure 5:
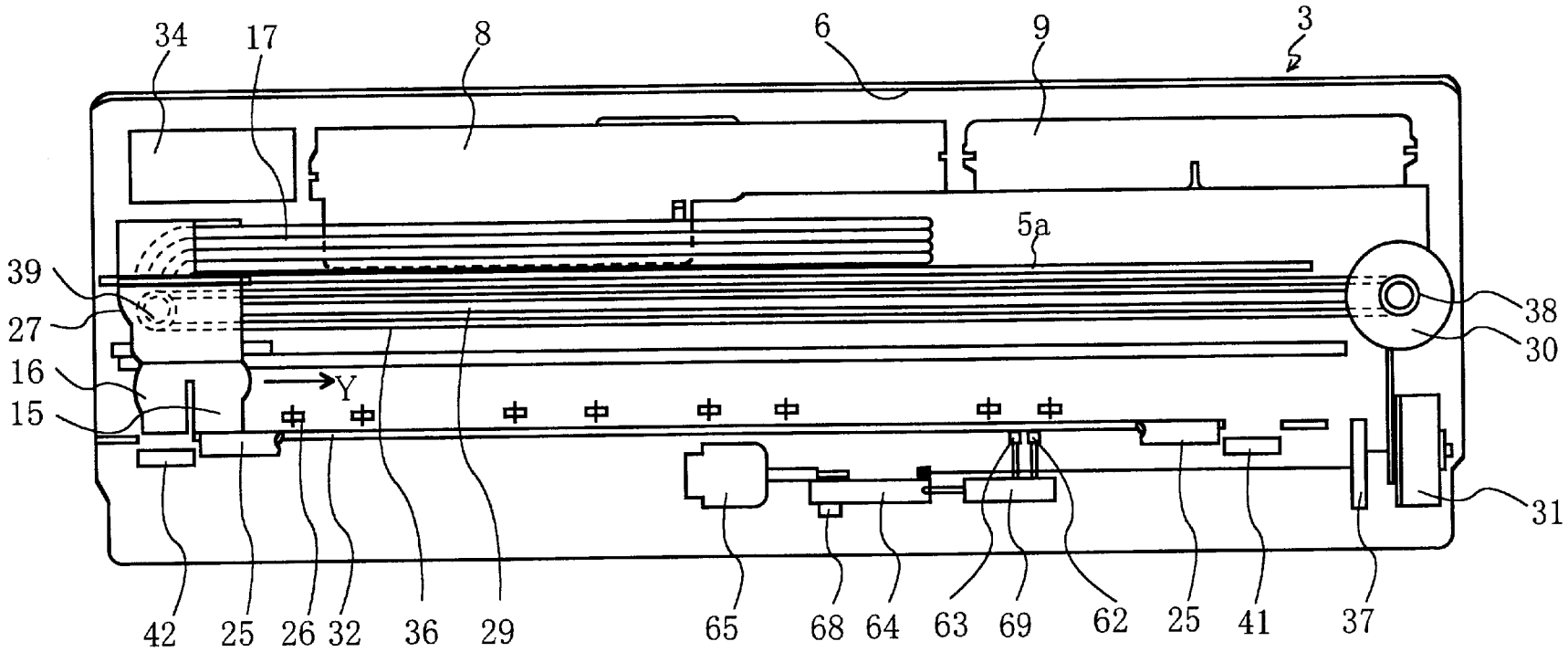
FIG. 5 is a schematic sectional view of the portable printer taken on line V—V of FIG. 4, viewed from the right-side end of the portable printer.

FIG. 5 is a sectional view of the portable printer 1 taken on line V—V of FIG. 4. In FIG. 5, an arrow Y indicates the direction of movement of the carriage 27. The central portion of the discharge roller 25 is omitted in FIG. 5.

As shown in FIG. 5, the CR motor 30 that supplies driving force to reciprocatingly move the carriage 27 in the right-to-left directions in FIG. 5 (the direction of the arrow Y and the opposite direction) is disposed on an upper portion of the body frame 6, in a right-side portion of the printer body 3. Disposed below the CR motor 30 is the LF motor 31 that rotates the conveying roller 23 and discharge roller 25.

The portable printer 1 of this embodiment performs the flushing operation in the flushing areas 41, 42 at the start and end of each printing operation and at every elapse of 10 seconds during the printing operation. The ink is ejected to a pre-disposed ink absorber in order to renew the ink whose viscosity has increased due to long-time dwelling in nozzle opening. The clogging of the nozzles openings is thereby prevented.

The purge operation and a mechanism thereof will be described below. Similar to the flushing operation, the purge operation is mainly intended to prevent the clogging of the nozzles 15*a*, 16*a* of the print heads 15, 16. When the printer is not used, the print heads 15, 16 are covered with the caps 62, 63 in order to substantially prevent the print heads 15, 16 from drying. However, the actual sealing of the caps 62, 63 is not perfect, so that ink in the print heads 15, 16 gradually dries although the heads are covered with the caps 62, 63. Therefore, if the printer is left unused for a long time, ink in the nozzles 15*a*, 16*a* become dry and viscous so that: the ink might not be removed by the flushing operation. In such a case, by the use of the caps 62, 63, a suction pump 65 is operated forcibly discharge the highly viscous ink from the nozzles 15*a*, 16*a*.

Figure 6:
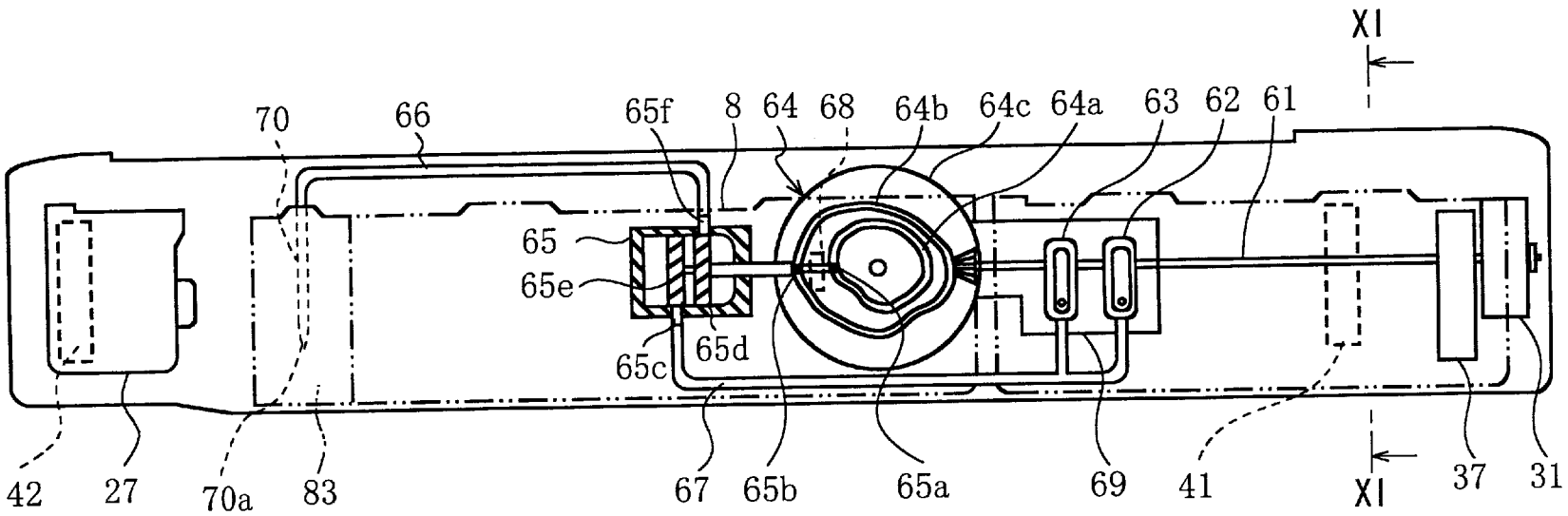
FIG. 6 is a schematic partial sectional view of the portable printer taken on line VI—VI of FIG. 1, viewed from the upper side of the portable printer.

The method of operating the portable printer 1 will be described with reference to FIGS. 2 and 4. When the power is turned on after the cartridges 8, 9 have been set, the purge operation of sucking ink from the nozzle openings to discharge dry ink or ink containing air bubbles or dirt or the like before printing is started, in order to ensure good quality printing. As the initial position at the time of power-on, the nozzles 15*a*, 16*a* of the print heads 15, 16 are tightly sealed with the caps 62, 63. Therefore, the driving power is transmitted to the pump driving gear 61 from the LF motor 31 via the LF motor gear 37 to perform the purge operation, as shown in FIG. 6.

After that, the operation of the carriage 27 is checked, and the carriage 27 is stopped at the initial position for the start of printing. When an unused print sheet PP is inserted into the insert opening 22 of the portable printer 1, the print sheet PP is conveyed below the print heads 15, 16 by the pressure roller 24 and the conveying roller 23 rotated by the LF motor 31. When the print sheet PP passes under the print heads 15, 16 which reciprocatingly move in the main scanning direction, that is, the direction of the arrow Y and the opposite direction, the print sheet PP is printed by inks ejected from the nozzles 15*a*, 16*a* of the print heads 15, 16.

Each of the four colored ink flows from the ink packs 9*a* of the ink cartridges 8, 9 into the corresponding ink extracting needles 10 inserted into the each of ink packs 8*a*, 9*a*, via the extracting holes of the ink extracting needles 10. The ink flows from the ink extracting needles 10 into the four ink supply tubes 12 via the communication openings (not shown) of the coupling members 11. The ink is thus supplied into the print heads 15, 16, so that the ink can be ejected from the nozzles 15*a*, 16*a* of the print heads 15, 16. After printing, the printed print sheet PP is discharged out of the sheet discharge opening 4 by the pressure roller 26 and the discharge roller 25 rotated by the LF motor 31.

As described above, the print heads 15, 16 mounted on the carriage 27 driven by the CR motor 30, perform printing by ejecting the ink from the nozzles 15*a*, 16*a* while being reciprocatingly moved in the lower space 1*b* of the portable printer 1 in the direction of the arrow Y shown in FIG. 2 and in the opposite direction. As the print heads 15, 16 mounted on the carriage 27 reciprocatingly move in this manner, the four ink supply tubes 12 connected to the upper portion of the print heads 15, 16 also move reciporcatingly. When the print heads 15, 16 move to the right-side portion (right side in FIG. 2) in the lower space 1*b* of the portable printer 1, portions of the ink supply tubes 12 closer to the print heads 15, 16 are curved. The curved portion (bend or folded portion) of the stack of the ink supply tubes 12 is supported by the partition plate 5*a* disposed in the upper space 1*a* of the portable printer 1. The ink supply tubes 12 are curved toward the connecting portion provided in the upper portion of the print heads 15, 16 disposed in the upper space 1*a* of the portable printer 1.

The flushing operation is performed at the start and end of printing and at every elapse of approx. 10 seconds during printing, by withdrawing the print heads 15, 16 into either one of the flushing areas. After printing, the carriage 27 stops at a position over on the caps 62, 63, and then the purge operation is performed once by transmitting driving force from the LF motor 31 to the pump driving gear 61 via the LF motor gear 37. The caps 62, 63 are raised and stopped to tightly cover the nozzles 15*a*, 16*a* in order to prevent the nozzles 15*a*, 16*a* from drying while the nozzles 15*a*, 16*a* are left unoperated.

Figure 11:
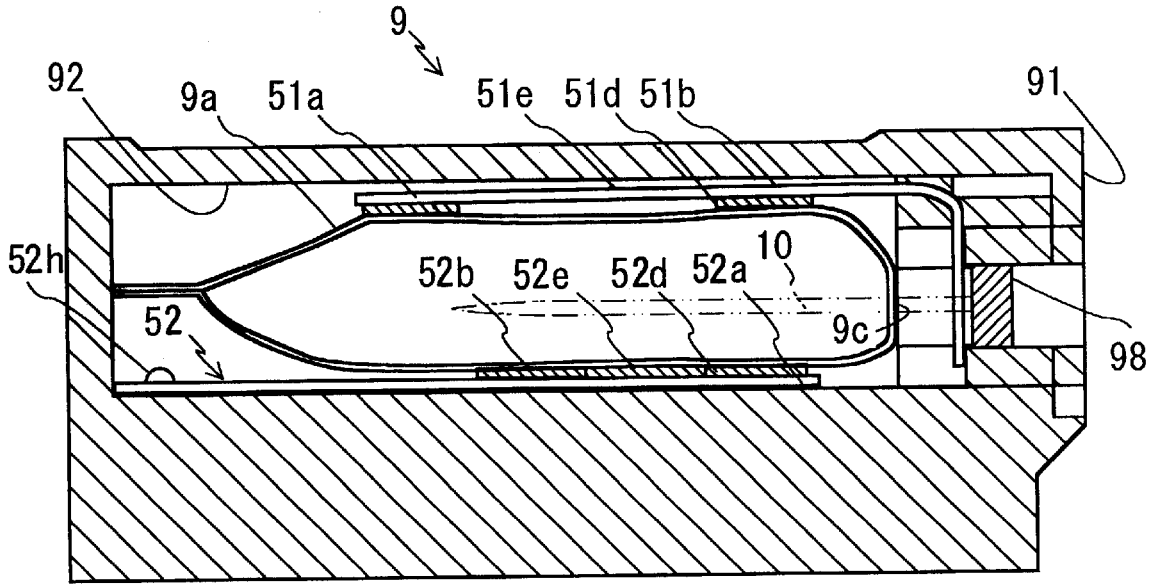
FIG. 11 is a schematic sectional view of the small ink pack 9 taken on line XI—XI of FIG. 6, illustrating a state that the small ink pack 9*a* is filled up with ink.
Figure 12:
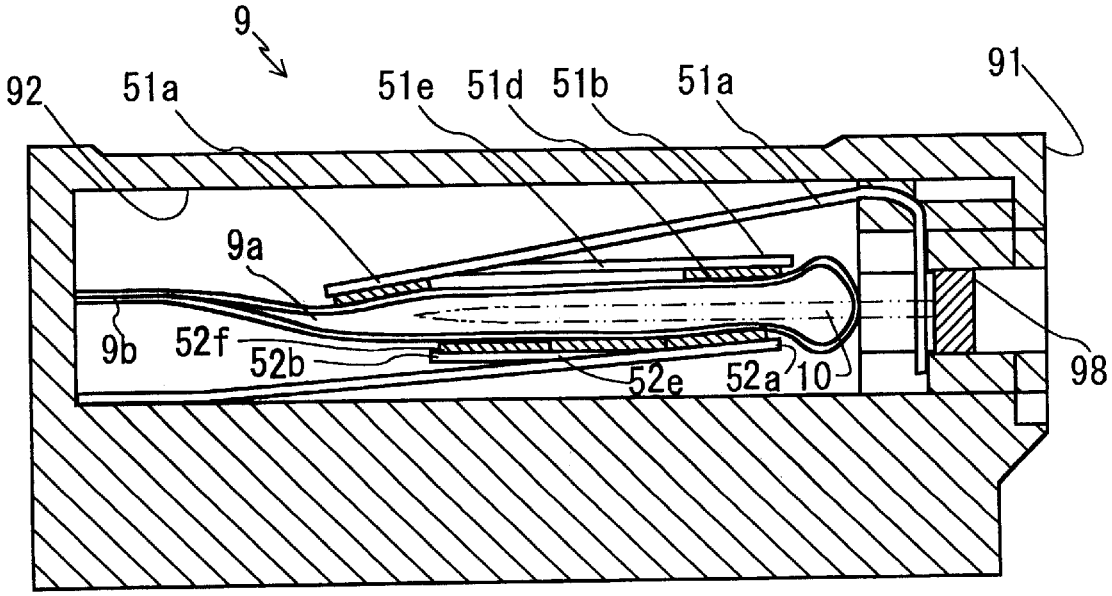
FIG. 12 is a schematic sectional view of the small ink pack 9*a* taken on line XI—XI of FIG. 6, illustrating a state that the ink in the small ink pack 9*a* is reduced.

The mechanism common to the ink cartridges 8, 9 of this embodiment will be described in detail, taking the small ink cartridge 9 as an example. FIG. 11 is a schematic sectional view of the small ink pack 9*a* taken on line XI—XI of FIG. 6, illustrating a state that the small ink pack 9*a* is filled up with ink. In this state, the small ink pack 9*a* fully contains the ink therein. The small ink pack 9*a* is disposed in the ink pack housing 92 so that the small ink pack 9*a* occupies the whole space of the ink pack housing 92. As shown in FIG. 7B, the angle formed by the fixing portion 51*c* and the outer portion 51*a* are approximately 110 degrees when the upper supporting spring 51 is in a free state. In the state shown in FIG. 11, the angle formed between the fixing portion 51*c* and the outer portion 51*a* is approximately 90 degrees, since the fixing portion 51*c* is fixed on the cartridge body 91 and the lower surface of the upper supporting spring 51 is attached to the upper surface of the small ink pack 9*a*. Due to the elasticity of upper supporting spring 51, the upper supporting spring 51 urges/pulls the small ink pack 9*a* to the upper side of the figure, applying negative pressures to the small ink pack 9*a*. While the upper supporting spring 51 is urging/pulling the small ink pack 9*a* upwardly, the small ink pack 9*a* is held in a posture with a small space maintained at the ceiling of the ink pack housing 92 of the cartridge body 91.

The lower supporting spring 52 is substantially in contact with the lower surface of the ink pack housing 92. FIG. 11 shows the position of the ink extracting needle 10 inserted into the small ink pack 9*a*. The ink extracting needle 10 is inserted into the insert portion 9*c* in the substantially central portion of the small ink pack 9*a* when the upper and lower surfaces thereof are fixedly attached to the upper supporting spring 51 and the lower supporting spring 52.

When the! ink is used and the volume of the ink contained in the small ink pack 9*a* decreases, the bag of the small ink pack 9*a* deforms downwardly by the atmospheric pressure and the volume of the small ink pack 9*a* decreases in accordance with the volume of the ink therein. According to the downward deformation of the bag of the small ink pack

9*a*, the upper supporting spring 51 is pulled downwardly with the tape application sections 51*d* on the outer portion 51*a* as well as the tape application sections 51*d* on the central portion 51*b* attached to the small ink pack 9*a*. Since the central portion 51*b* is supported by the relatively narrow central supporting portions 51*e* with low elasticity, the central portion 51*b* follows the deformation of the small ink pack 9*a* flexibly.

When the small ink pack 9*a* deforms upwardly due to the decreases in the volume of the small ink pack 9*a*, the lower supporting spring 52 is raised with the tape application section 52*d* of connected area on the outer surface 52*a*, the central portion 52*b*, and the central supporting portions 52*e*, following the deformation of the small ink pack 9*a*.

While the upper supporting spring 51 and the lower supporting spring 52 are following the deformation of the small ink pack 9*a*, the appropriate negative pressures are applied to the small ink pack 9*a*, and the pressures of the ink in the small ink pack 9*a* can be adjusted at appropriate negative pressures. If the upper supporting spring 51 and the lower supporting spring 52 are not used, the internal pressures of the ink in the small ink pack 9*a* having relatively low in rigidity and strength on the walls thereof, are applied up to approximately 1 atmospheric pressure, unless the walls of the small ink pack 9*a* are formed from materials having the high rigidity and strength. Furthermore, the height difference between the print heads 15, 16 and the ink pack 9*a* is approx. 60 mm in this embodiment. Due to the height difference, the hydraulic pressure of approx. 60 Aq (water column) is also applied to the print heads 15, 16. Therefore, meniscuses cannot be properly formed in the nozzles openings of the print heads 15, 16, resulting in excessive amounts of ink droplets ejected, splattered inks, and the like.

Figure 13:
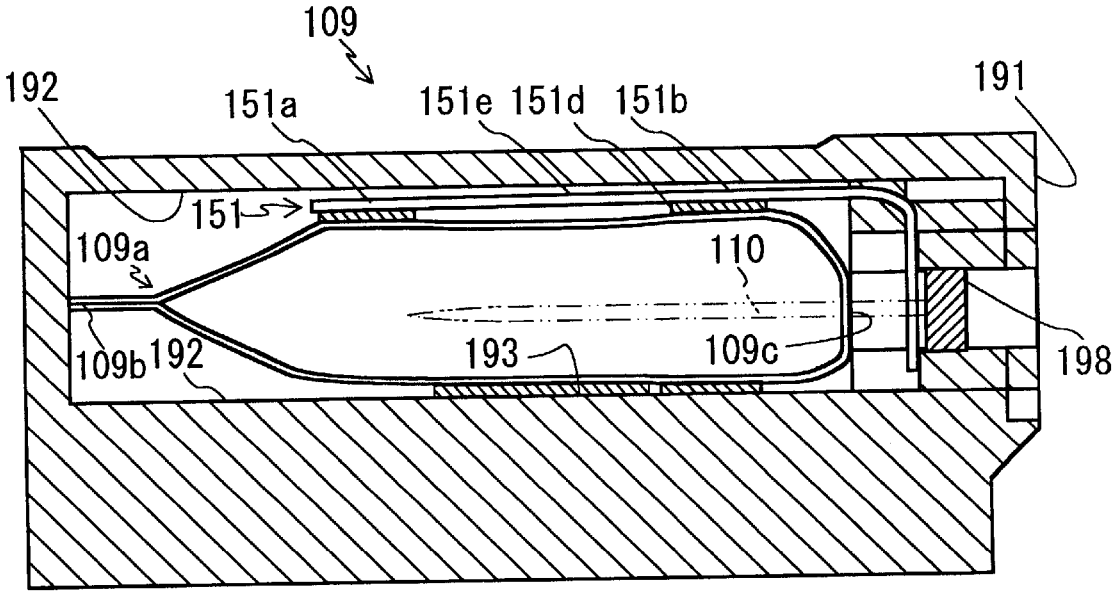
FIG. 13 is a schematic sectional view of the conventional small ink pack from a perspective similar to a view that would be taken on line XI—XI of FIG. 6, illustrating a state that the conventional small ink pack is filled up with ink.
Figure 14:
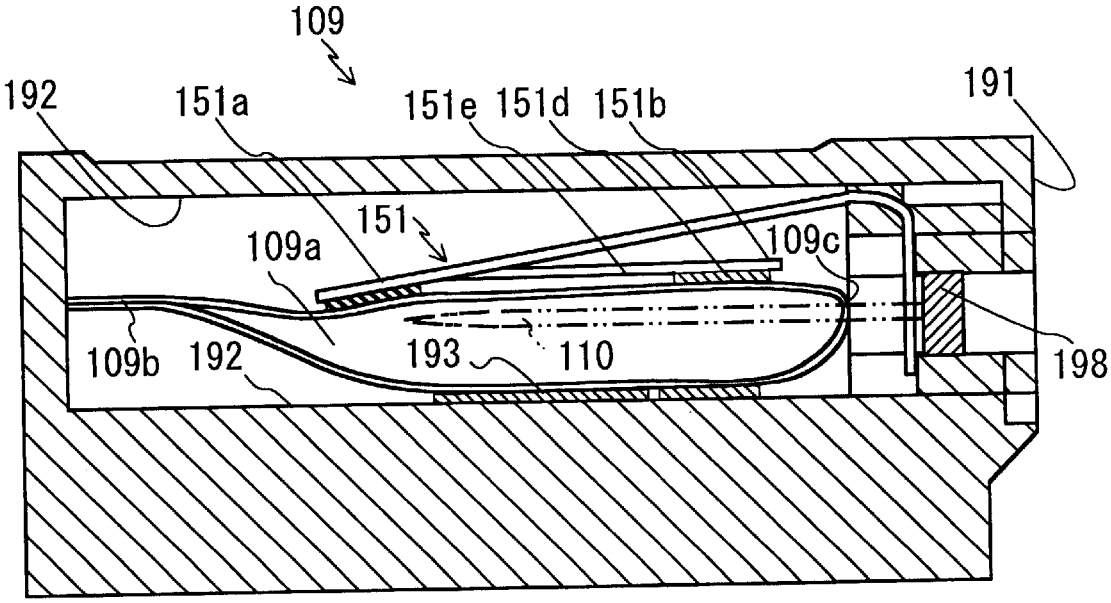
FIG. 14 is a schematic sectional view of the conventional small ink pack from a perspective similar to a view that would be taken on line XI—XI of FIG. 6, illustrating a state that the ink in the conventional small ink pack is reduced.

A conventional ink pack will be described below with reference to FIGS. 13 and 14. FIG. 13 shows a state that the conventional small ink pack 109*a* is filled up with ink. In the conventional ink cartridges, the upper supporting spring 151 is constructed as the same as that of this embodiment, while the lower supporting spring is not used. The small ink pack 109*a* is directly adhered to the lower surface of the ink pack housing 192. In this state, any major differences cannot be observed with the ink cartridge of this embodiment shown in FIG. 11. As the ink is used and the volume of the ink contained in the small ink pack 109*a* decreases, the upper supporting spring 151 bends down to follow the deformation of the small ink pack 109*a* and applies negative pressures thereto. However, the lower surface of the small ink pack 109*a* will not deform since it is adhered to the lower surface of the ink pack housing 192. As the volume of the small ink pack 109*a* decreases and the inner surface of the upper side of the small ink pack 109*a* makes contact with the ink extracting needle 110, the small ink pack 109*a* will not be able to deform any further. In this state, the ink cannot be extracted or supplied to a print head (not shown) due to the excessive negative pressures applied. Therefore, the ink cannot be ejected for printing. Ink remains in the small ink pack 109*a* and may be unused. The small ink cartridge 109 with the ink remaining has to be disposed of and the ink is wasted. Also, the time during which the ink can be continuously used becomes short, regardless of the ink contained in a small ink cartridge 109 at the beginning of its use.

The disposition of the ink extracting needle 10 at the lower position close to the lower surface of the ink pack housing 92 is considered. When the distal end of the ink extracting needle 10 is inserted into the wall of the bag of the small ink pack 9*a*, it needs to be inserted perpendicular to the wall of the bag of the small ink pack 9*a*. Otherwise, the ink extracting needle 10 will not be able to be inserted into the bag of the small ink pack 9*a*, or when the ink extracting needle 10 is inserted at an angle, ink may leak therefrom. Therefore, the ink extracting needle 10 cannot be disposed at the position far away from the central portion.

In the ink cartridges 8, 9 of this embodiment, appropriate negative pressures can be maintained from the start to the end of the ink usage, and ink is supplied without any ink being wasted, as described above taking the small ink cartridge 9 as an example.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

For example, the upper supporting spring 51 and the lower supporting spring 52 may be uniformly formed by a thin plate, although the upper supporting spring 51 and the lower supporting spring 52 are formed by a separate member in this embodiment. More specifically, a connecting portion that extends outwardly from the outer portion 52*a* of the lower supporting spring 52 and is connected to the fixing portion 51*c* of the upper supporting spring 51 may be provided. The structure allows the punching process of materials only once. Furthermore, the lower supporting spring 52 does not have to be fixed to the housing.

A second embodiment of the invention will be described in detail below. The structure common to the ink cartridges 8, 9 will be described in detail, taking the small ink cartridge 9 as an example.

Figure 16A:
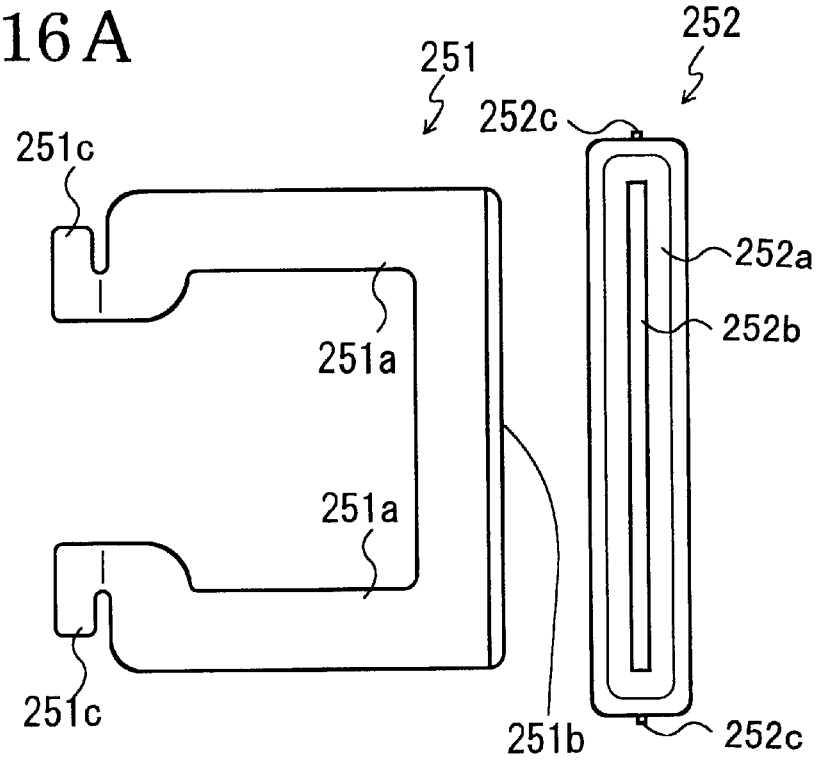
FIG. 16A is a plan view of a supporting spring 251 and an engagement portion 252.
Figure 16B:
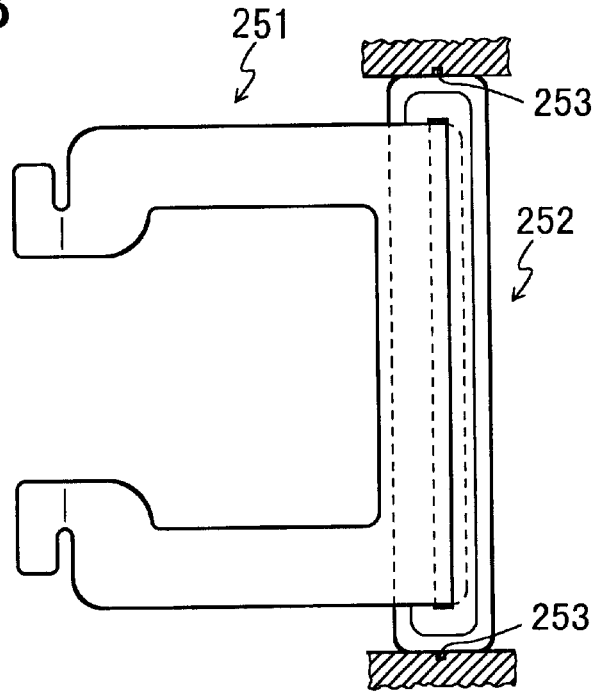
FIG. 16B is a plan view of the supporting spring 251 and the engagement portion 252 engaged with each other.
Figure 17:
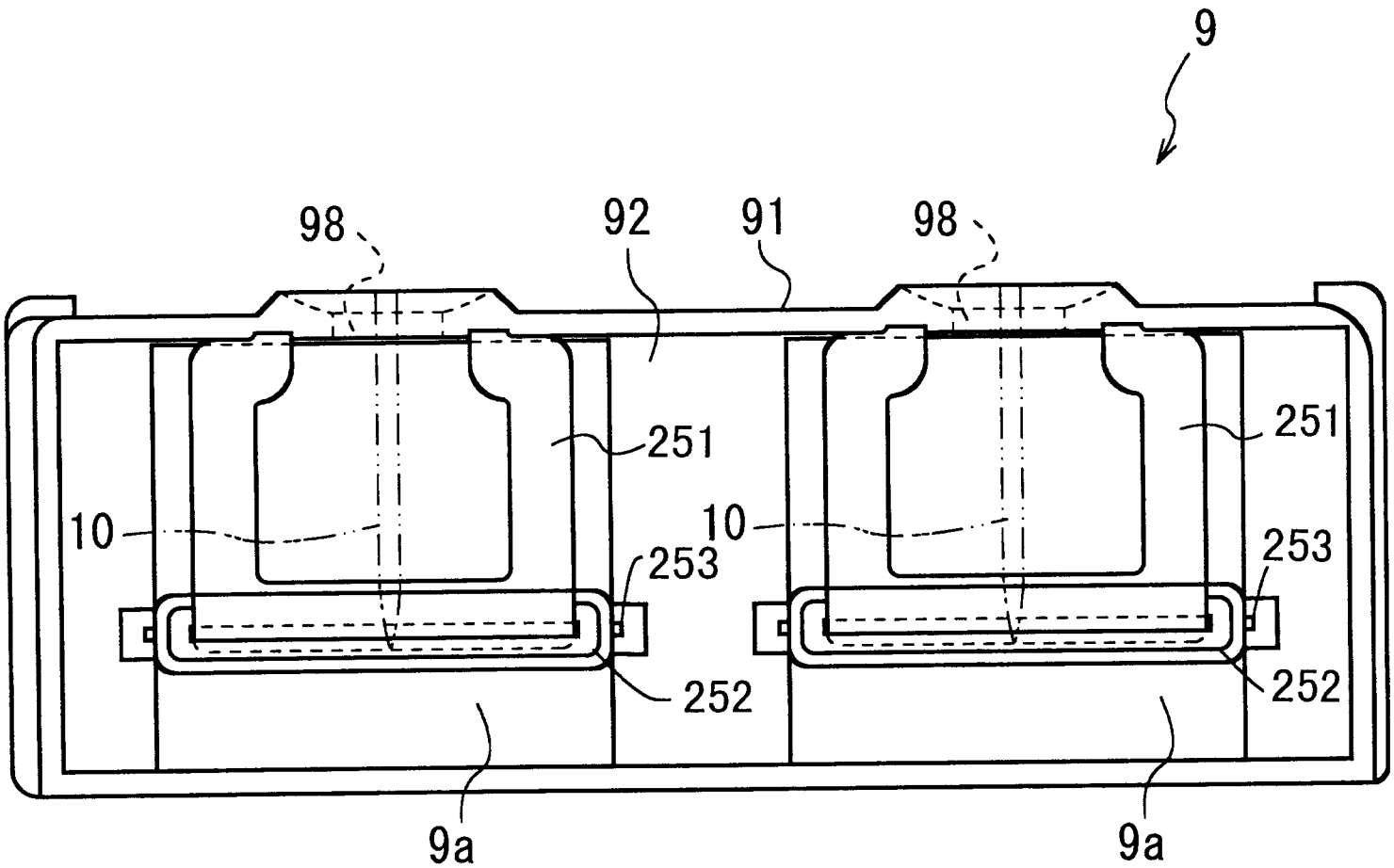
FIG. 17 is a plan sectional view of the small ink pack 9*a* taken on line Z—Z of FIG. 4, viewed from the upper side of the small ink pack 9*a;*
Figure 20:
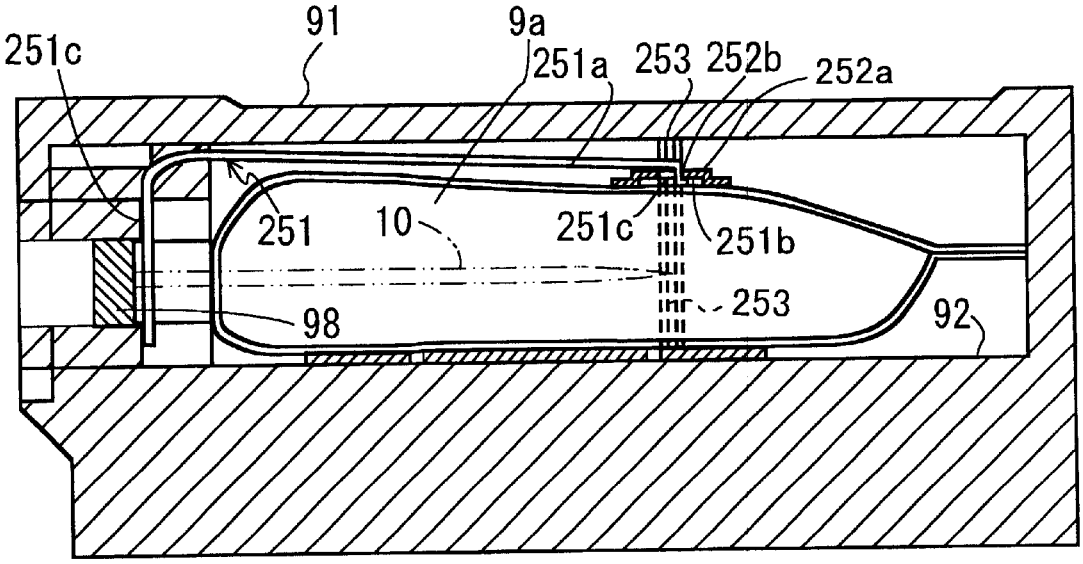
FIG. 20 is a schematic sectional view of the small ink pack 9 taken on line XI—XI of FIG. 6, illustrating a state that the small ink pack 9*a* is filled up with ink.

FIG. 16A is a plan view of a supporting spring 251 and an engagement portion 252 before they are engaged with each other. FIG. 16B is a plan view of the supporting spring 251 and the engagement portion 252 engaged with each other. FIG. 20 is a schematic sectional view of the small ink pack 9 taken on line XI—XI of FIG. 6, illustrating a state that the small ink pack 9*a* is filled up with ink The supporting spring 251 and the engagement portion 252 will be described below with reference to FIGS. 16 and 20.

As shown in FIG. 16A, the supporting spring 251 is formed by punching and bending an elastic plate spring made of a thin plate of stainless steel. The supporting spring 251 has a substantially C-shaped outer portion 251*a* and a fixing portion 251*c*. The fixing portions 251*c* are a pair of protruding portions bent so as to be fixedly inserted into the slits (not shown) on the cartridge body 91 (see FIG. 20). To the opposite side of the fixing portions 251*c*, an engagement catch 251*b* is provided. As shown in FIG. 20, the engagement catch 251*b* is bent downwardly and then bent horizontally to the direction of the end of the engagement catch 251*b* (direction opposite to the fixing portions 251*c*). The engagement catch 251*b* is inserted into an engagement groove 252*b* of the engagement portion 252 (described below) and is engaged in the edge of the engagement groove 252*b*.

In the above-described structure, the angle formed between the fixing portion 251*c* fixed into the cartridge body 91 and the outer portion 251*a* fixed to the small ink pack 9*a* via the engagement portion 252 is smaller than that formed between the fixing portion 251*c* and the outer portion 251*a* when they are in a free state. The fixing portion 251*c* fixed into the cartridge body 91 and the outer portion 251*a* fixed to the small ink pack 9*a* via the engagement portion 252 tends to restore the original angle due to the elasticity of the supporting spring 251. Since the fixing portion 251*c* is fixedly inserted into the slit (not shown) on the cartridge body 91, the supporting spring 251 pulls the outer portion 251*a* fixed to the small ink pack 9*a* via the engagement portion 252 upwardly by applying urging forces to the wall of the bag of the small ink pack 9*a* so as to restore the original angle!. Since the wall of the bag of the small ink pack 9*a* is urged/pulled to the direction that the volumes of the bag is enlarged, the pressure applied to the liquid ink in the bag decreases if the contents in the bag is the same, and appropriate negative pressures can be applied to the liquid ink.

The lower surface of the engagement portion 252 is attached to the top surface of the small ink pack 9*a* with the a double-sided adhesive tape applied to the tape application section. As can be seen in FIG. 20, the body 252*a* of the engagement portion 252 has a cross section of a convex shape in the right-to-left directions in FIG. 16A. Provided in the convex central portion is the engagement groove 252*b*. The engagement catch 251*b* is inserted into the engagement groove 252*b* and engaged in the end-side edge (right-side edge thereof in FIG. 20) of the engagement groove 252*b*, and urging forces applied by the supporting spring 251 are transmitted to the small ink pack 9*a*. Protrusions of guide lugs 252*c* are provided on the engagement portion 252 at the top and bottom ends in FIG. 16A. The guide lugs 252*c* are fitted into the grooves on a pair of guide rails 253 provided on the opposite inner faces of the ink pack housing 92 of the cartridge body 91. The guide lugs 252*c* fitted into the grooves on the guide rails 253 slide therealong. The two guide rails 253 provided horizontally and vertically regulate the position of the engagement portion 252 in the horizontal direction and guides its movement in the vertical direction according to the decrease in inks contained in the small pack 9*a*.

Figure 18:
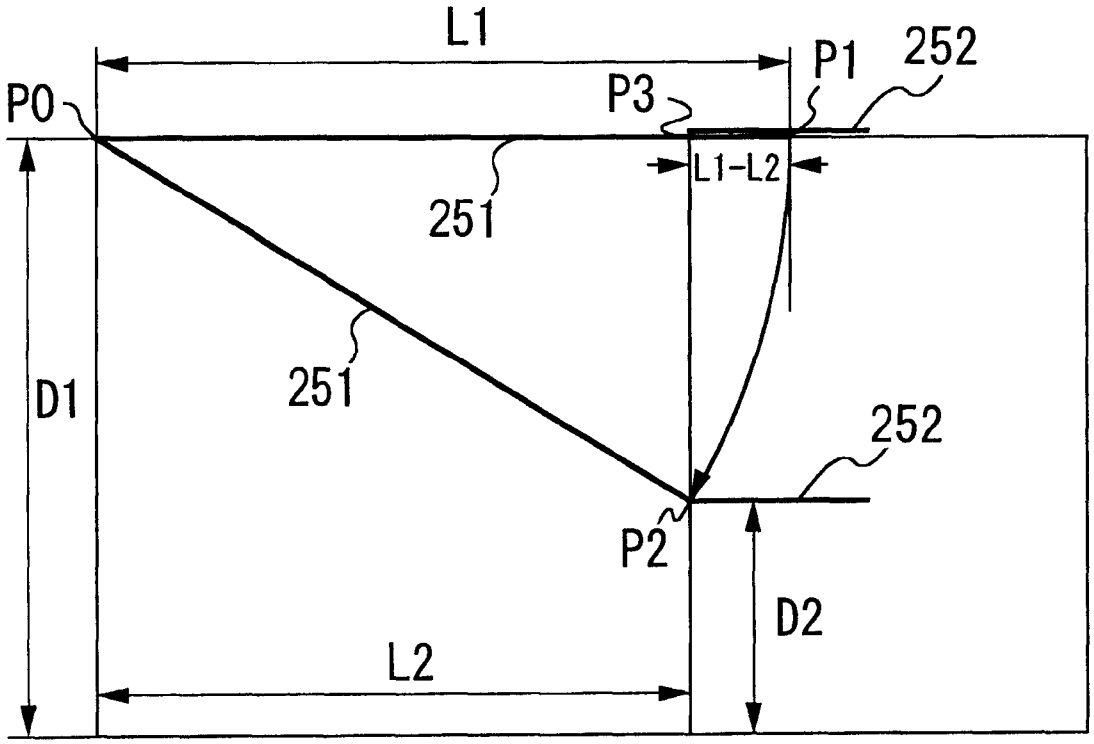
FIG. 18 is a schematic figure showing the relationship between an engagement catch 251*b* and the engagement portion 252 for the former to be released from the latter.

FIG. 18 is a schematic figure showing the relationship between the supporting spring 251 and the engagement portion 252 of the second embodiment structured as described above. D1 in FIG. 18 indicates the thickness of the small ink pack 9*a* when the ink is filled up in the small ink pack 9*a*. D2 in FIG. 18 indicates the thickness of the small ink pack 9*a* when the amount of the ink contained in the small ink pack 9*a* decreases and where the engagement catch 251*b* is released from the engagement groove 252*b*. P0 indicates the center when the supporting spring 251 bends. L1 indicates the horizontal distance between the P0 and the end of the engagement catch 251*b*. L2 indicates the distance between the P0 and the end-side edge of the engagement groove 252*b* of the engagement portion 252. P1 indicates the position of the end of the engagement catch 251*b* when the ink is filled up in the small ink pack 9*a*. P3 indicates the position of the end-side edge of the engagement groove 252*b* of the engagement portion 252 when the ink is filled up in the small ink pack 9*a*. The engaging length of the engagement catch 251*b* and the engagement groove 252*b* is obtained by L1 minus L2. Since the L1 is longer than L2 when the ink is filled up in the small ink pack 9*a*, the supporting spring 251 is engaged in the engagement portion 252.

When the ink in the small ink pack 9*a* is used, the end of the engagement catch 251*b* in the position P1 gradually moves down along an arc with respect to the point 20, and the position of the end of the engagement catch 251*b* moves toward the left side in FIG. 18. When the end of the engagement catch 251*b* reaches P2 as the ink decreases, L1 becomes equal to L2. In this case, the end of the engagement catch 251*b* and the edge of the engagement groove 252*b* are unable to engage, and the supporting spring 251 springs up by its elasticity. Therefore, the small ink pack 9*a* does not receive urging forces from the supporting spring 251 after the engagement catch 251*b* is released from the edge of the engagement groove 252*b*. That is, negative pressures are then applied to the ink contained in the small ink pack 9*a* by the elasticity due to the rigidity and strength of the small ink pack 9*a*.

The mechanism common to the ink cartridges 8, 9 will be described in detail, taking the small ink cartridge 9 as an example. FIG. 20 is a plane sectional view of the small ink pack 9*a* taken on line XI—XI of FIG. 6, illustrating the small ink pack 9*a* filled up with ink. In this state, the small ink pack 9*a* fully contains the ink therein. The supporting spring 251 urges/pulls the small ink pack 9*a* upwardly by its elasticity to apply negative pressures thereto. The amount of movement or deformation of the supporting spring 251 is small when the ink pack 9*a* is filled up with ink, and the urging forces applied are relatively small.

The lower surface of the small ink pack 9*a* is attached to the lower surface of the ink pack housing 92 with double-sided adhesive tape. When the ink is used and the volume of the ink in the small ink pack 9*a* decreases, the small ink pack 9*a* deforms due to the atmospheric pressure in accordance with the volume of the ink in the small ink pack 9*a*. According to the downward deformation of the small ink pack 9*a*, the supporting spring 251 is pulled downwardly with the engagement catch 251*b* inserted into the engagement portion 252 adhered to the small ink pack 9*a*. The amount of movement or deformation of the supporting spring 251 becomes larger as the ink is used and the volume of the ink in the small ink pack 9*a* decreases, and the urging forces applied become gradually larger.

Figure 21:
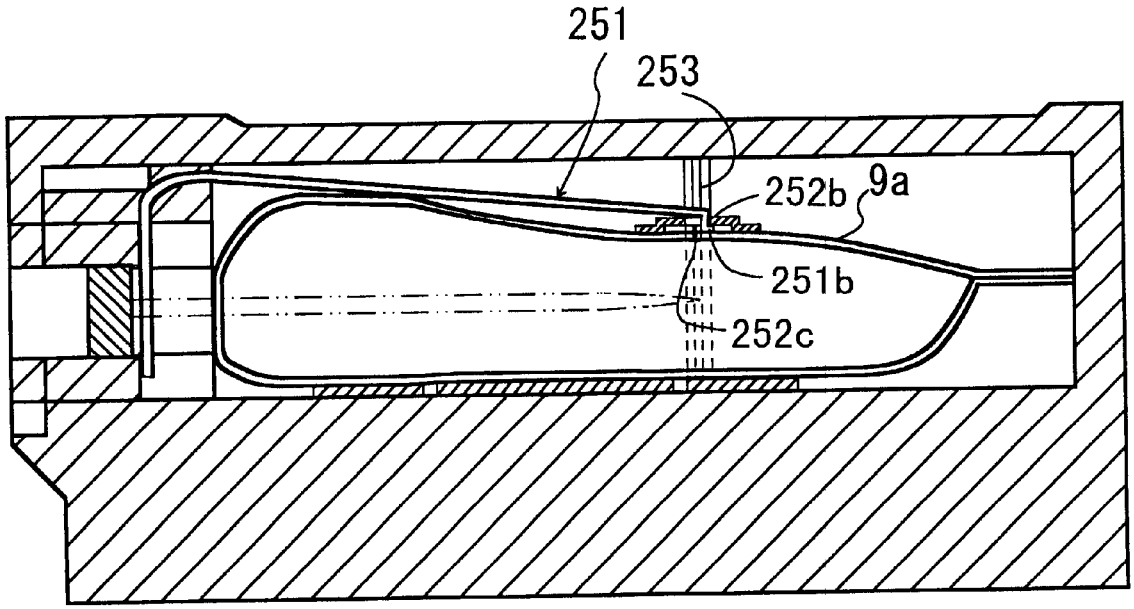
FIG. 21 is a schematic sectional view of the small ink pack 9 taken on line XI—XI of FIG. 6, illustrating a state that the ink in the small ink pack 9 is reduced from the state shown in FIG. 20.

FIG. 21 shows the small ink pack 9*a* containing less ink than that shown in FIG. 20, due to the use of ink. According to the decrease in the volume of the small pack 9*a* from the state shown in FIG. 20, the engagement portion 252 adhered to the small ink pack 9*a* moves vertically down with the positions of guide lugs 252*c* horizontally regulated by the guide rails 253. In this state, the end of the engagement catch 251*b* is engaged in the edge of the engagement groove 252*b*, and the supporting spring 251 urges/pulls the small ink pack 9*a* so as to apply negative pressures.

Figure 22:
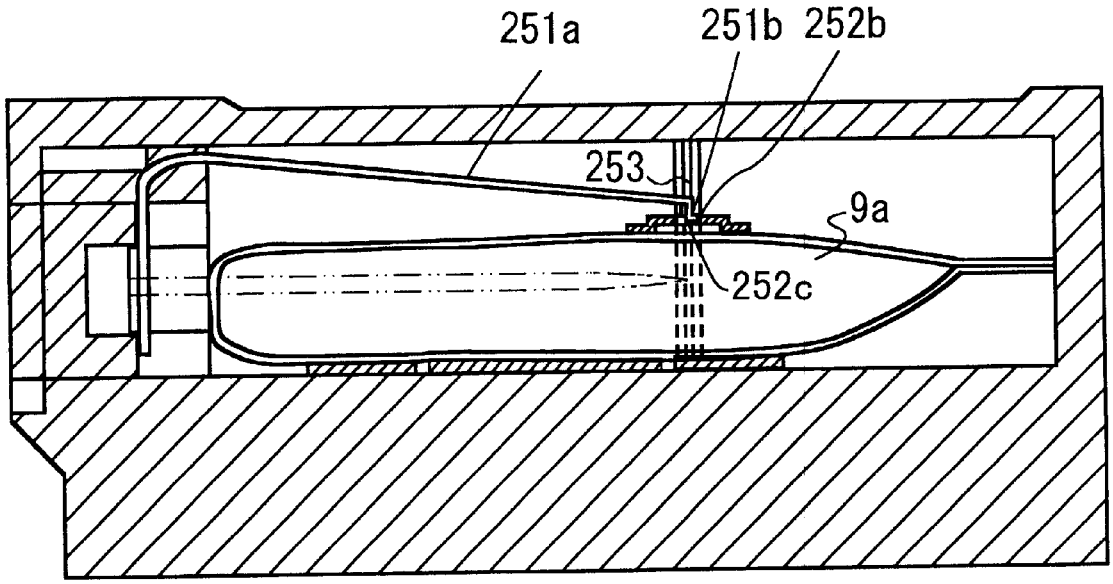
FIG. 22 is a schematic sectional view of the small ink pack 9 taken on line XI—XI of FIG. 6, illustrating a state that the ink in the small ink pack 9 is reduced from the state shown in FIG. 21.

FIG. 22 shows the small ink pack 9*a* containing less ink than that shown in FIG. 21, due to further use of ink. According to the decrease in the volume of the small pack 9*a* from the state shown in FIG. 21, the engagement portion 252 adhered to the small ink pack 9*a* moves vertically down with the positions of the guide lugs 252*c* horizontally regulated by the guide rails 253. In this state, the engagement catch 251*b* at the end of the supporting spring 251 is not engaged in but released from the edge of the engagement groove 252*b* of the engagement portion 252.

Figure 23:
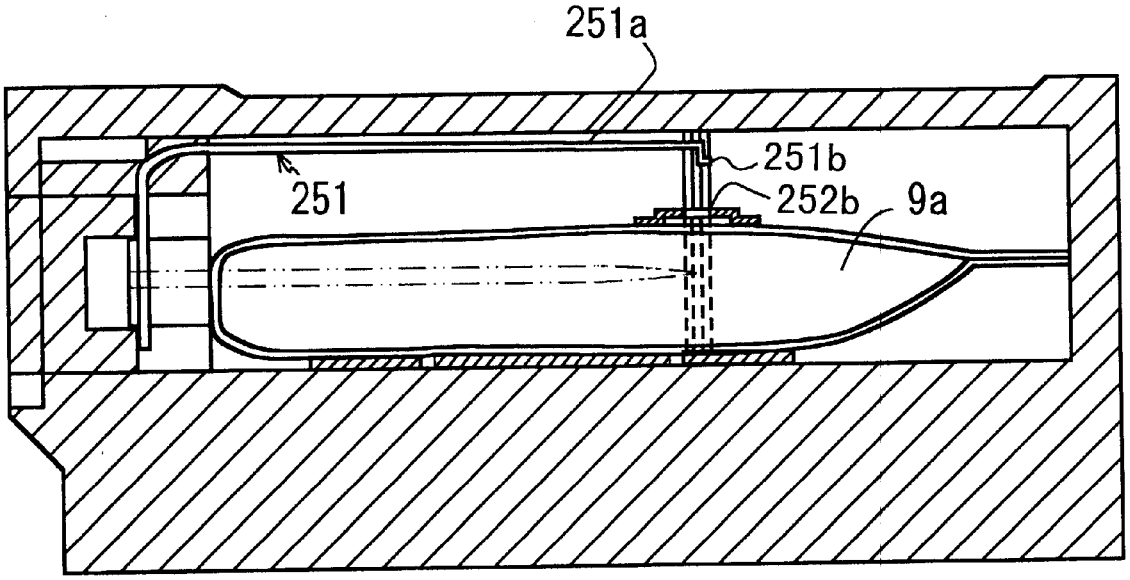
FIG. 23 is a schematic sectional view of the small ink pack 9 taken on line XI—XI of FIG. 6, illustrating a state that the ink in the small ink pack 9 is reduced from the state shown in FIG. 22.

FIG. 23 shows the condition of the small ink pack 9*a* after the engagement catch 251*b* is released from the engagement groove 252*b*. As shown in FIG. 23, the engagement catch 251*b* has been sprung up due to the elasticity of the outer portion 251*a*. Thereafter, the supporting spring 251 does not urge/pull the small ink pack 9*a* upwardly.

Figure 24:
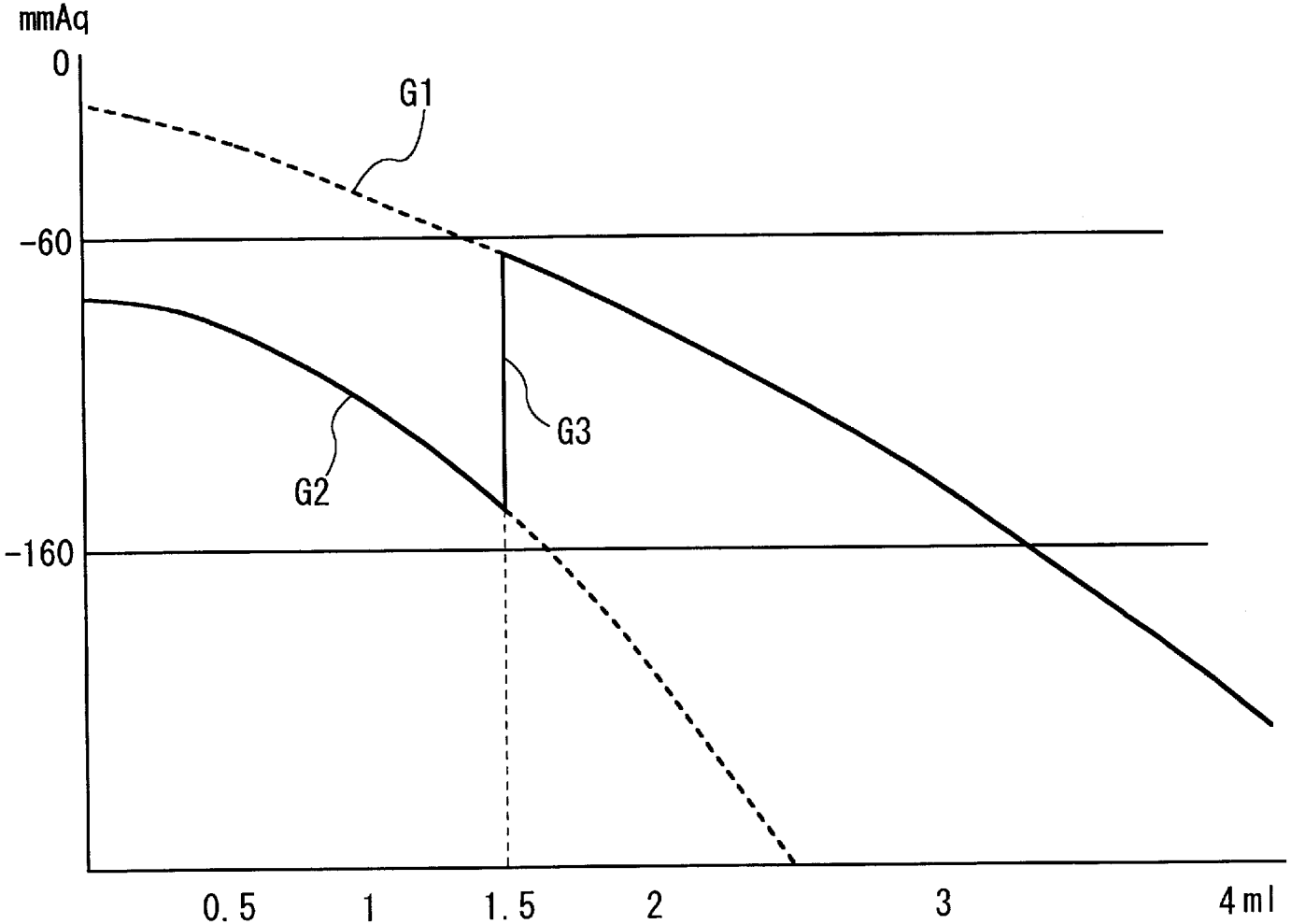
FIG. 24 is a graph showing the relationship between the amount of ink used from the small ink pack 9*a* and the internal pressure in the small ink pack 9*a;*

Taking the small ink pack 9*a* as an example, the relationship between the amount of ink used from the ink packs 9*a* and the internal pressure therein. FIG. 24 is a graph showing the relationship between the amount of ink used from the small ink pack 9*a* and the internal pressure therein. The vertical line indicates the internal pressure applied to the liquid ink in the small ink pack 9*a*. The internal pressure is expressed in the unit of mmAq (water column) The horizontal axis indicates the amount of ink used from the small ink pack 9*a*. The amount of ink used from the small ink pack 9*a* is expressed in the unit of ml. The curve G1 starting with a dashed line and then connected to a solid line, indicates the negative pressure due to the elasticity of the small ink pack 9*a*. The curve G2 starting with a solid line and then connected to a dashed line, indicates the negative pressure applied by the supporting spring 251. To form proper meniscuses as described above, the pressure needs to fall within the range of 0 mmaq (water column) to −300 mmAq (water column), preferably within the range of −60 mmAq (water column) to −160 mmAq (water column) in the small ink pack 9*a*.

If only the elasticity of the small ink pack 9*a* is used to apply the negative pressure thereto, the internal pressure of the small ink pack 9*a* is 0 mmAq (water column) at the start of its use, which is above −60 mmAq (water column) of the preferable negative pressure. Consequently, excessive amounts of ink droplets may be ejected or ink may be splattered. If the supporting spring 251 is used to urge/pull the small ink pack 9*a* upwardly, the internal pressure of the small ink pack 9*a* at the start of its use is under −60 mmAq (water column) and falls within the preferable range, as indicated by the curve G2. Therefore, appropriate negative pressure to form the proper meniscuses is obtained and proper printing can be performed.

If the small ink pack 9*a* from which the ink of approx. 1.5 ml is used, is continuously urged/pulled by the supporting spring 251, the amount of deformation of the supporting spring 251 becomes large and excessive urging forces are applied to the small ink pack 9*a*. When the excessive urging forces are applied, the internal pressure of the small ink pack 9*a* is below the preferably negative pressure of −160 mmAq (water column). Consequently, ink may be blurred or it may not be ejected. In this case, if the small ink pack 9*a* is urged/pulled by its elasticity, the internal pressure of the small ink pack 9*a* falls within the preferable range of −160 mmAq (water column) and −60 mmaq (water column) When the approximately 1.5 ml of ink is used from the small ink pack 9*a*, the supporting spring 251 is released from the engagement portion 252 and does not urge/pull the small ink pack 9*a* upwardly. This will be further explained with reference to FIG. 24. If less than 1.5 ml of ink is used from the small ink pack 9*a*, the supporting spring 251 urges/pulls the small ink pack 9*a* upwardly and appropriate negative pressure can be maintained as indicated by the curve G2. If approximately 1.5 ml of ink is used, the supporting spring 251 stops urging/pulling the small ink pack 9*a* upwardly by the above-described structure. Thereafter, as the internal pressure of the small ink pack 9*a* is expressed by the curve G1 via line G3, the appropriate negative pressure can be maintained when more than 1.5 ml of ink is used. Although the foregoing second embodiment is described above taking the small ink cartridge 9 as an example, the same structure and the same principle as the small ink pack 9*a* are applied to the large ink pack, and the internal pressure of the large ink pack can be maintained at the appropriate negative pressures.

The above-described second embodiment is an example and the above-described conditions will vary according to printing apparatus, materials and sizes of the bag of the ink pack, urging/pulling mechanism to be used, and the like. The important point is to supply ink by applying appropriate negative pressures to ink supply sources using a plurality of urging/pulling mechanisms at the right timing.

As explained above, the ink cartridges 8, 9 of the second embodiment supply ink by maintaining the appropriate negative pressure from the start to the end of the ink usage.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

Figure 25A:
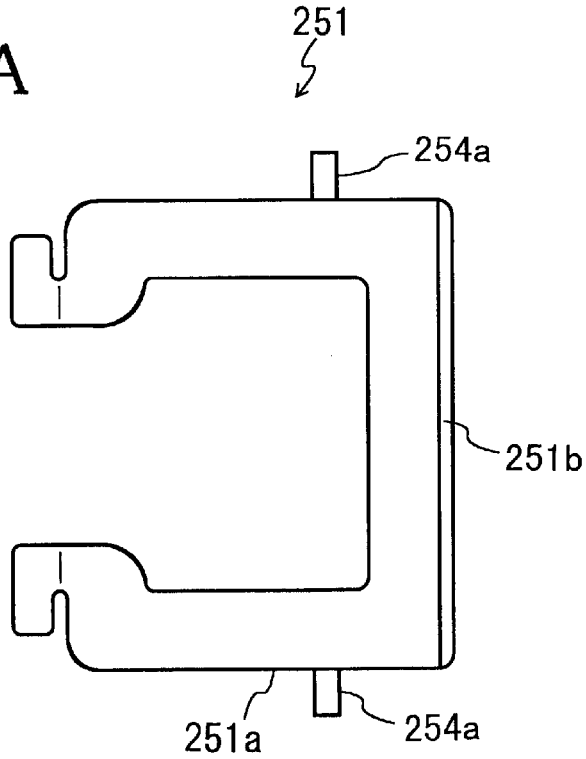
FIG. 25A is a figure showing an engagement catch guide (supporting spring-side guide) 254*a* of one embodiment of the invention.
Figure 25B:
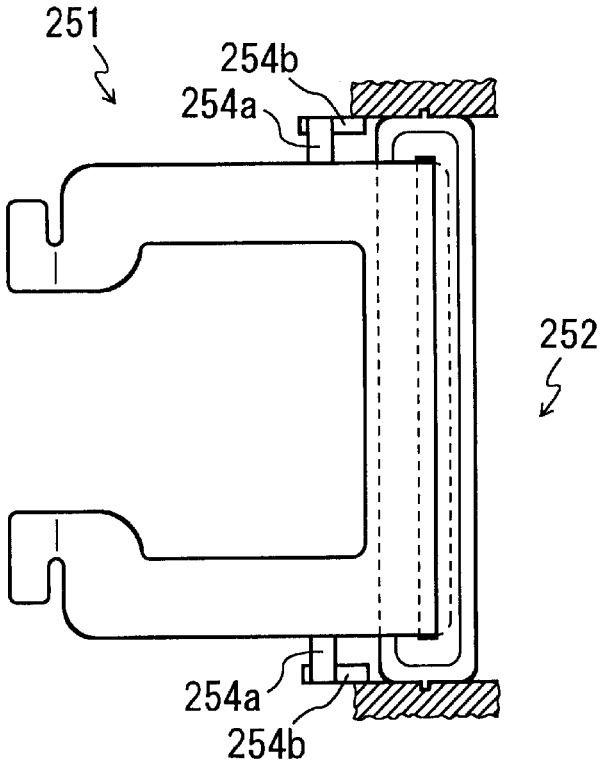
FIG. 25B is a figure showing the engagement catch guide (supporting spring-side guide) 254*a* guided by an engagement catch guide (cartridge body-side guide) 254*b;*

For example, in addition to the structure described in the second embodiment, it is desirable to provide an engagement catch guide 254 to precisely regulate the position of the engagement catch 251*b*. FIG. 25A shows the construction of the engagement catch guide 254. The engagement catch guide 254 includes a supporting spring-side guide 254*a* and a cartridge body-side guide 254*b*. As shown in FIG. 25A, the engagement catch guide 254 (supporting spring-side guide 254*a*) is provided on the supporting spring 251. The supporting spring-side guide 254*a* is a pair of protrusions extending outwardly and symmetrically from the outer portion 251*a* of the supporting spring 251 near the end side of the supporting spring 251. The supporting spring-side guide 254*a* is provided parallel to the end of the engagement catch 251*b*. As shown in FIG. 25B, the engagement catch guide 254 (cartridge body-side guide 254*b*) is provided on the lower surface of the ink pack housing 92 of the cartridge body 91 so as to contact to the supporting spring-side guide 254*a* at the end-side (right side thereof in FIG. 25).

Figure 26A:
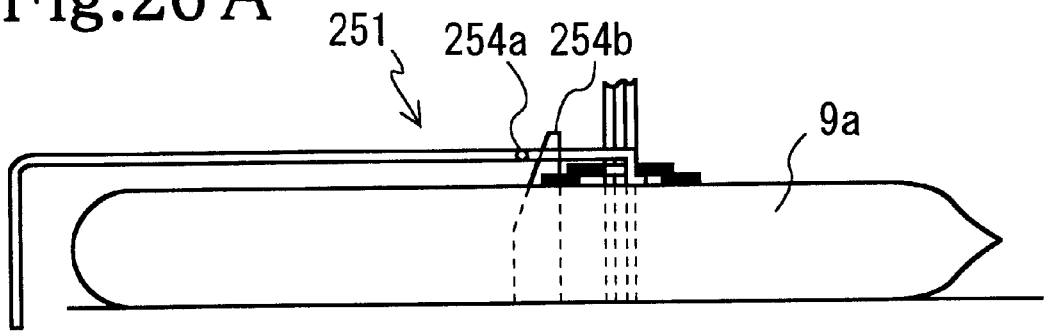
FIG. 26A is a figure showing a state before the engagement catch guide (supporting spring-side guide) 254*a* is guided by the engagement catch guide (cartridge body-side guide) 254*b;*

The action of the engagement catch guide 254*a* is explained with reference to FIGS. 26A, 26B, and 26C. FIG. 26A shows the small ink pack 9*a* filled up with ink. In this state, the supporting spring-side guide 254*a* and the cartridge body-side guide 254*b* of the engagement catch guide 254 do not contact each other but stay slightly away from each other. Therefore, the supporting spring-side guide 254*a* and the cartridge body-side guide 254*b* do not interact with each other.

Figure 26B:
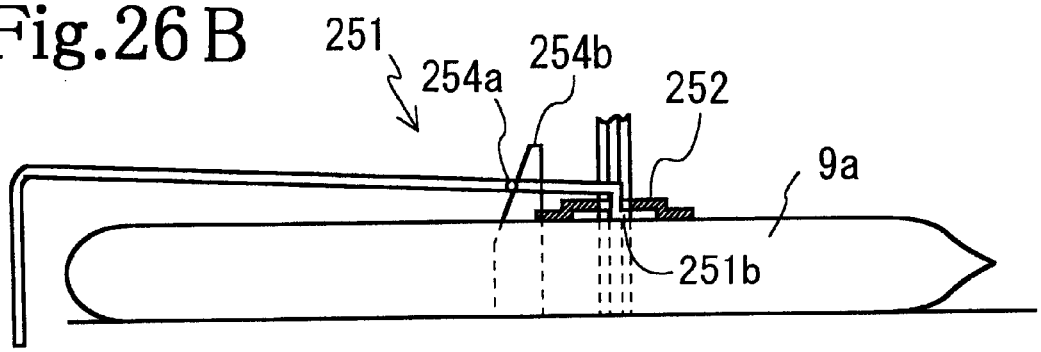
FIG. 26B is a figure showing a state that the engagement catch guide (supporting spring-side guide) 254*a* is guided by the engagement catch guide (cartridge body-side guide) 254*b*.
Figure 26C:
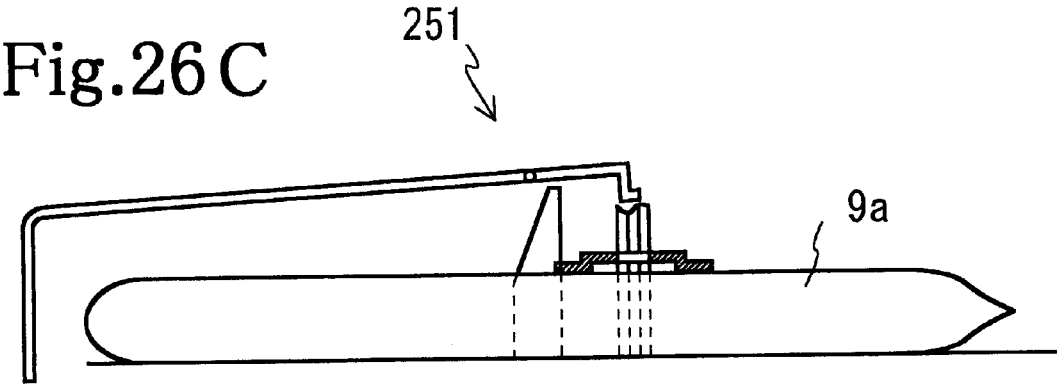
FIG. 26C is a figure showing a state that the guidance of the engagement catch guide (supporting spring-side guide) 254*a* by the engagement catch guide (cartridge body-side guide) 254*b*, have been released.

FIG. 26B shows the supporting spring 251 bending down due to the use of ink from the small ink pack 9*a*. In this state, the supporting spring-side guide 254*a* and the cartridge body-side guide 254*b* of the engagement catch guide 254 contact each other. The cartridge body-side guide 254*b* does not move since it is fixed on the cartridge body 91. On the other hand, the supporting spring-side guide 254*a* is able to move slightly to the right-to-left side in FIG. 26 since the supporting spring 251 is elastic. Due to the slight movement of the supporting spring 251, the timing in releasing the supporting spring 251 from the engagement portion 252 might be thrown off from the predetermined timing. By contacting the supporting spring-side guide 254*a* to the cartridge body-side guide 254*b*, the position of the supporting plate 251 can be precisely regulated, and the engagement catch 251*b* can be released from the engagement portion 252 at the right timing, as shown in FIG. 26C. With the engagement catch guide 254, the supporting spring 251 can be released at the precise position in accordance with the amount of the ink used.

Figure 19:
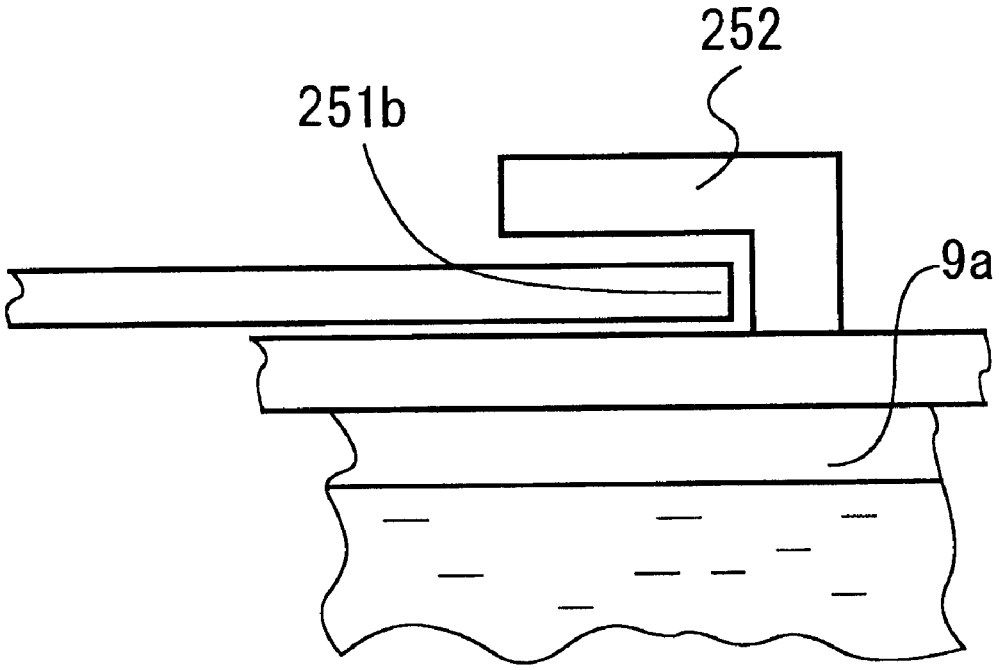
FIG. 19 is a figure showing the supporting spring 251 and the engagement portion 252 of one embodiment of the invention.

As shown in FIG. 19, the engagement catch with a straight end may be used.

The urging/pulling mechanism is not limited to plate springs, but various kinds of mechanisms may be used. The urging/pulling mechanism using the elasticity of the ink pack as described in the second embodiment, as well as attaching the plate spring to a bag of an ink pack may be used.

As described above in conjunction with the second embodiments, the invention is not limited to ink jet type print heads, but may be applied to other types of print heads that eject ink onto the recording medium for printing. Moreover, this invention can be applied to ink transfer type printers.

As is apparent from the foregoing description, the ink cartridge of this invention includes a flexible bag of an ink pack that contains a liquid ink, a housing that houses the ink pack and has a box shape, an ink extracting portion provided at a side surface of the housing, into which a hollow ink extracting needle is inserted for extracting the ink from the ink pack contained in the housing, and a pair of plate springs provided so as to dispose the ink extracting portion therebetween and movably supported with one end thereof at a portion of the housing for urging/pulling the ink pack to the directions opposite to each other so that the volumes of the ink pack is enlarged by fixing a portion of the plate spring to the ink pack. Since the ink cartridge of this invention has two plate springs, they can be disposed according to the shape of the ink pack, and the ink pack can be urged/pulled upwardly and downwardly so as to apply negative pressures thereto. The ink remained in the ink pack can be reduced and greater amounts of ink can be used from the ink pack urged/pulled by two plate springs than that urged/pulled by one plate spring, if the ink pack contains the same amount of ink. Consequently, the running costs of the printer are cut down and the time during which the printer can continuously be used becomes long.

Furthermore, since the two plate springs are used to urge/pull the ink pack, appropriate negative pressures can be applied to the ink pack in a wider range with respect to the amount of ink usage, than one plate spring used to apply negative pressures, wherein small amounts of urging/pulling forces are applied to the ink pack filled up with the ink and when the ink is used and the volume of the ink decreases, the greater amount of urging/pulling forces are applied as the application point of the urging/pulling forces is changed and the plate spring bends down. Since the appropriate negative pressures can be maintained from the start to the end of the ink usage using two plate springs, meniscuses (curved surfaces) of ink liquid are properly formed in the nozzles of the ink jet print head and the poor printing such as excessive amounts of ink droplets ejected, splattered inks, ink blurred, and no ink ejected will not occur.

In the ink cartridge of the invention, at least one of the pair of plate springs is supported near the ink extracting portion so as to dispose the ink extracting needle therebetween when the ink extracting needle is inserted. Since the ink cartridge of this invention has two plate springs, they can be disposed according to the shape of the ink pack, especially according to the position of the ink extracting needle, and the ink pack can be urged/pulled upwardly and downwardly as to apply negative pressures thereto. The ink remaining in the ink pack can be reduced and greater amounts of ink can be used from the ink pack urged/pulled by two plate springs than that urged/pulled by one plate spring, if the ink pack contains the same amounts of ink. Consequently, the running costs of the printer are cut down and the time during which the printer can continuously be used becomes long.

At least one of the pair of plate springs has a substantially C- or O-shaped outer portion whose one end is movably supported at the housing and a central portion movably supported with an inner surface of the outer portion at the opposite side of the supporting portion of the outer portion, wherein the central portion is fixed to the ink pack. Since the substantial length of the plate spring can be extended, the appropriate urging/pulling forces can be applied when the application point of the urging/pulling forces to the ink pack is greatly changed and appropriate negative pressure can be applied to the ink pack in a wide range in respect to the amount of ink usage. Since the appropriate negative pressure can be maintained from the start to the end of the ink usage, meniscuses (curved surfaces) of ink liquid are properly formed in the nozzles of the ink jet print heads and the poor printing such as excessive amounts of ink droplets ejected, splattered inks, ink blurred, and no ink ejected will not occur.

The substantially C- or O-shaped outer portion of the at least one of the pair of plate springs whose one end is movably supported at the housing, is supported at the portion opposite to that the outer portion of the other plate spring is supported at. Therefore, the two plate springs interact with each other to maintain appropriate negative pressures and to effectively reduce the ink remained in the ink pack.

In the ink cartridge of this invention, the pair of plate springs are uniformly formed. Therefore, it becomes possible to effectively produce one piece of plate spring.

Further, the housing contains a plurality of the ink packs. Therefore, it becomes possible to supply a plurality of types of ink to a printing apparatus that performs printing using a plurality of types of ink for color printing.

In the ink cartridge of the invention, the ink is supplied to an ink jet print head included in an image forming apparatus. Therefore, it becomes possible to properly supply the ink to the ink jet print head of the image forming apparatus.

The ink cartridge of the invention includes a flexible bag of an ink pack that contains a liquid ink, a housing that houses the ink pack, a first urging/pulling device that urges/pulls the bag of the ink pack to apply negative pressure to the liquid ink contained in the ink pack, a second urging/pulling device that applies negative pressure with a smaller amount of force than the first urging/pulling device does, a releasing device that releases the first urging/pulling device therefrom. Since the releasing device releases the first urging/pulling device therefrom according to the amount of ink in the ink pack, appropriate negative pressure can be maintained with different amounts of urging/pulling forces applied. By adjusting the pressure of the liquid ink to be supplied at a negative pressure appropriate for printing, proper meniscuses can be formed, and high-quality printing can be produced.

The releasing device includes an engagement portion fixed to the ink pack and an engagement catch, provided on the first urging/pulling device, to be engaged in the engagement portion, wherein the engagement catch engaged in the engagement portion is released by the positional change of the engagement portion due to the decrease in the amount of ink in the ink pack. Since the releasing device releases the first urging/pulling device therefrom using the engagement portion that changes its position according to the amount of ink used, urging/pulling forces are adjusted according to the amount of ink used. Therefore, the appropriate urging/pulling forces are applied regardless of the amount of ink used, applying negative pressure appropriate for printing, to the ink.

Further, the releasing device has the engagement portion fixed to an opposite side of the ink pack fixed to the inner wall of the housing with a portion thereof and the engagement catch of a plate spring forming the first urging/pulling device whose one end is fixed to the inner wall of the housing with the predetermined supporting point, wherein the engagement catch is engaged in the engagement portion so as to urge/pull the ink pack for applying negative pressures thereto when more than a predetermined amount of liquid ink are filled in the ink pack, and the engagement portion releases the engagement catch therefrom when the predetermined amount of ink is used from the ink pack by changing its position downwardly from the supporting point of the first urging/pulling device as the ink is used. Since the walls of the ink pack deforms or moves when ink is used, when a predetermined amount of ink is used, the first urging/pulling device is mechanically released with the use of deformation or movement of the walls of the ink pack. After the first urging/pulling device is released, the second urging/pulling device is employed to apply appropriate urging/pulling forces to the ink pack. Therefore, the appropriate urging/pulling forces are applied regardless of the amount of ink used, applying negative pressures appropriate for printing, to the ink.

The releasing device includes a guide member to guide the positional change of the engagement portion. Since the guide member guides the engagement portion, and regulates the path of the engagement portion according to the amount of ink used, the distance from the supporting points of the first urging/pulling device to the engagement portion is accurately regulated according to the amount of ink used, and the first urging/pulling device can be released at the right time when the predetermined ink is used.

Furthermore, the releasing device includes the guide member to guide the end of the engagement catch. Since the engagement catch changes its position with the end of the engagement catch regulated by the guide member, the first urging/pulling device can be released at the right time when the predetermined ink is used.

The second urging/pulling device urges/pulls the ink pack with the elasticity of the ink pack. Since the second urging/pulling device uses the elasticity of the ink pack, other urging/pulling mechanisms do not have to be provided. Therefore, the compact design of the ink cartridge can be pursued.

The ink pack is urged/pulled with the rigidity and strength on the walls increased by the lamination of a plurality of synthetic resin films. Since the rigidity and strength of the walls of the ink pack is increased by the lamination of a plurality of synthetic resin films, the appropriate negative pressure can be applied to the ink to be supplied.

The second urging/pulling device urges/pulls the ink pack by a plate spring attached to the ink pack. Since the plate spring is used to urge/pull the ink pack, the appropriate urging/pulling forces can be applied regardless of the ink pack material by flexibly adjusting the elasticity of the plate spring.

In the ink cartridge of the invention, a plurality of ink packs are provided. Therefore, it can accommodate a printing apparatus that performs color printing or that produces various tones of colors.

The housing has an ink extracting portion having a rubber member into which a hollow ink extracting needle is inserted to extract the ink from the ink pack contained in the housing. Therefore, it becomes possible to extract the ink from the ink pack via the ink extracting needle, and the constriction of the ink pack can be simplified. Furthermore, even if the ink is leaked out of the portion where the ink extracting needle is inserted, the ink extracting portion having the rubber member prevents the ink from leaking out of the ink cartridge, so that the printing apparatus or its users will not be soiled with the ink.

In the ink cartridge of the invention, the ink is supplied to an ink jet print head included in an image forming apparatus. The liquid ink whose pressures are kept at the appropriate negative pressures can be supplied to an ink jet print head which is easily affected especially by the negative pressures of the liquid ink to be supplied. Therefore, the meniscuses can properly formed, producing high-quality images.

In the ink cartridge of the invention, the ink is supplied to the ink jet print head via a tube. Since appropriate negative pressure is applied to the liquid ink despite the pressure attributable to the height differences between the bag of the ink pack and the ink jet print head, the liquid ink whose pressure is kept at the appropriate pressure, can be supplied from the bag of the ink pack to the ink jet print head via the tube. Therefore, high-quality images can be produced.

What is claimed is:

1. An ink cartridge for use with a hollow ink extracting needle, ink in the ink cartridge being supplied to a printing mechanism having at least one ink ejecting nozzle, the ink cartridge comprising:

a flexible ink pack that contains liquid ink, the flexible ink pack having at least two opposing sheet walls;

a housing that houses the ink pack and is box shaped; an ink extracting portion provided at a side surface of the housing, into which the hollow ink extracting needle is inserted to extract the ink from the ink pack housed in the housing; and first and second cantilever plate springs independently provided so as to dispose the ink extracting portion therebetween, each first and second cantilever plate springs having at least one cantilevered portion being cantilevered in the housing and at least one fixed portion being respectively fixed at said at least two opposing sheet walls of said flexible ink pack to urge/pull said at least two opposing sheet walls to opposite directions so that the volume of the ink pack is enlarged, wherein the first and second cantilever plate springs add negative pressures to the ink in the ink cartridge so as to form an appropriate concave meniscus in the nozzle opening for good print quality until the first and second cantilever plate springs are substantially close to the hollow ink extracting needle and the ink in the ink cartridge is almost emptied.

2. The ink cartridge according to claim 1, wherein the at least one of said first and second cantilever plate springs has at least one of a substantially C-shaped and O-shaped outer portion, said first and second cantilever plate springs having a central portion movably supported with an inner surface of the outer portion at the opposite side of the cantilevered portion of the outer portion, at least the central portion being fixed to the ink pack.

3. The ink cartridge according to claim 1, wherein said first and second cantilever plate springs are uniformly formed.

4. The ink cartridge according to claim 1, wherein the housing contains a plurality of ink packs.

5. The ink cartridge according to claim 1, wherein the ink is supplied to an ink jet print head included in an image forming apparatus.

6. The ink cartridge according to claim 1, wherein the cantilevered portion of first cantilever plate spring is cantilevered near the ink extracting portion at the housing and the cantilevered portion of second cantilever plate spring is cantilevered at the opposite side of the ink extracting portion at the housing so as to dispose the ink extracting needle therebetween when the ink extracting needle is inserted.

7. The ink cartridge according to claim 1, wherein at least one of the fixed portions, to the ink pack, of first cantilever plate springs and at least one of the fixed portions, to the ink pack, of second cantilever plate springs are alternately provided on said at least two opposing sheet walls.

8. The ink cartridge according to claim 7, wherein a point of the hollow ink extracting needle is approximately provided in the middle of the ink pack.

9. An ink cartridge for use with a hollow ink extracting needle, ink in the ink cartridge being supplied to a printing mechanism having at least one ink ejecting nozzle, the ink cartridge comprising:

a flexible ink pack that contains liquid ink, the flexible ink pack having at least two opposing sheet walls;

a housing that houses the ink pack, the housing being box shaped;

an ink extracting portion provided at a side surface of the housing, into which the hollow ink extracting needle is inserted to extract the ink from the ink pack housed in the housing; and first and second cantilever plate springs independently provided so as to dispose the ink extracting portion therebetween, each first and second cantilever plate springs having at least one cantilevered portion being cantilevered in the housing and at least one fixed portion being respectively fixed at said at least two opposing sheet walls of said flexible ink pack to urge/pull said at least two opposing sheet walls to opposite directions so that the volume of the ink pack is enlarged, wherein the cantilevered portion of first cantilever plate spring is cantilevered near the ink extracting portion at the housing and the cantilevered portion of second cantilever plate spring is cantilevered at the opposite side of the ink extracting portion at the housing so as to dispose the ink extracting needle therebetween when the ink extracting needle is inserted, and wherein first and second cantilever plate springs are used as both fixing the position of the ink pack in the housing and giving appropriate negative pressures to the ink pack for proper printing, wherein the first and second cantilever plate springs add negative pressures to the ink in the ink cartridge so as to form an appropriate concave meniscus in the nozzle opening for good print quality until the first and second cantilever plate springs are substantially close to the hollow ink extracting needle and the ink in the ink cartridge is almost emptied.

10. The ink cartridge according to claim 9, wherein at least one of the fixed portions of first cantilever plate springs and at least one of the fixed portions of second cantilever plate springs are alternatively provided on said at least two opposing sheet walls.

11. The ink cartridge according to claim 10, wherein a point of the hollow ink extracting needle is approximately provided in the central portion of the ink pack.

12. An ink cartridge for use with a hollow ink extracting needle, ink in the ink cartridge being supplied to a printing mechanism having at least one ink ejecting nozzle, the ink cartridge comprising:

a flexible ink pack that contains liquid ink, the flexible ink pack having at least two opposing sheet walls;

a housing that houses the ink pack and is box shaped;

an ink extracting portion provided at a side surface of the housing, into which the hollow ink extracting needle is inserted to extract the ink from the ink pack housed in the housing; and first and second cantilever plate springs independently provided so as to dispose the ink extracting portion therebetween, each first and second cantilever plate springs having at least one cantilevered portion being cantilevered in the housing and at least one fixed portion being respectively fixed at said at least two opposing sheet walls of said flexible ink pack to urge/pull said at least two opposing sheet walls to opposite directions so that the volume of the ink pack is enlarged, wherein at least one of the fixed portions of first cantilever plate springs and at least one of the fixed portions of second cantilever plate springs are alternately provided on said at least two opposing sheet walls, wherein the first and second cantilever plate springs add negative pressures to the ink in the ink cartridge so as to form an appropriate concave meniscus in the nozzle opening for good print quality until the first and second cantilever plate springs are substantially close to the hollow ink extracting needle and the ink in the ink cartridge is almost emptied.

13. The ink cartridge according to claim 12, wherein a point of the hollow ink extracting needle is approximately provided in the central portion of the ink pack.

14. An image forming apparatus, comprising:

at least one print head having at least one ink ejecting nozzle;

at least one ink cartridge for use with a hollow ink extracting needle, the at least one ink cartridge supplying ink to the at least one print head and comprising:

a flexible ink pack that contains liquid ink, the flexible ink pack having at least two opposing sheet walls;

a housing that houses the ink pack, the housing being box shaped;

an ink extracting portion provided at a side surface of the housing, into which the hollow ink extracting needle is inserted to extract the ink from the ink pack housed in the housing; and first and second cantilever plate springs independently provided so as to dispose the ink extracting portion therebetween, each first and second cantilever plate springs having at least one cantilevered portion being cantilevered in the housing and at least one fixed portion being respectively fixed at said at least two opposing sheet walls of said flexible ink pack to urge/pull said at least two opposing sheet walls to opposite directions so that the volume of the ink pack is enlarged, wherein the first and second cantilever plate springs add negative pressures to the ink in the ink cartridge so as to form an appropriate concave meniscus in the nozzle opening for good print quality until the first and second cantilever plate springs are substantially close to the hollow ink extracting needle and the ink in the ink cartridge is almost emptied.

15. The image forming apparatus according to claim 14, wherein the at least one of the first and second cantilever plate springs has at least one of a substantially C-shaped and O-shaped outer portion, the first and second cantilever plate springs having a central portion movably supported with an inner surface of the outer portion at the opposite side of the cantilevered portion of the outer portion, at least the central portion being fixed to the ink pack.

16. The image forming apparatus according to claim 14, wherein the first and second cantilever plate springs are uniformly formed.

17. The image forming apparatus according to claim 14, wherein the housing contains a plurality of ink packs.

18. The image forming apparatus according to claim 14, wherein the cantilevered portions of the first cantilever plate springs are cantilevered near the ink extracting portion at the housing and the cantilevered portions of the second cantilever plate springs are cantilevered at the opposite side of the ink extracting portion at the housing so as to dispose the ink extracting needle therebetween when the ink extracting needle is inserted.

19. The image forming apparatus according to claim 14, wherein at least one of the fixed portions of the first cantilever plate springs and at least one of the fixed portions of the second cantilever plate springs are alternately provided on said at least two opposing sheet walls.

20. The image forming apparatus according to claim 19, wherein a point of the hollow ink extracting needle is approximately provided in the middle of the ink pack.

21. An ink cartridge for use with a hollow ink extracting needle, ink in the ink cartridge being supplied to a printing mechanism having at least one ink ejecting nozzle, the ink cartridge comprising:

a flexible ink pack that contains liquid ink, the flexible ink pack having at least two opposing sheet walls;

a housing that houses the ink pack and is box shaped;

an ink extracting portion provided at a side surface of the housing, into which the hollow ink extracting needle is inserted to extract the ink from the ink pack housed in the housing; and first and second cantilever plate springs independently provided so as to dispose the ink extracting portion therebetween, each first and second cantilever plate springs add negative pressures to the ink in the ink cartridge so as to form an appropriate concave meniscus in the nozzle opening for good print quality until the first and second cantilever plate springs are substantially close to the hollow ink extracting needle and the ink in the ink cartridge is almost emptied.

* * * * *